US008357054B2

(12) United States Patent
Myers et al.

(10) Patent No.: US 8,357,054 B2
(45) **Date of Patent: *Jan. 22, 2013**

(54) CHILD SWING AND JUMPER APPARATUS AND METHODS OF OPERATING THE SAME

(75) Inventors: Peter J. Myers, Wheaton, IL (US); Joseph P. Sejnowski, N. Kingstown, RI (US); Jeff Yaschur, Providence, RI (US); Bill Mussig, Seekonk, MA (US); Dan Nelsen, Providence, RI (US); Traci J. Barron, Saint John, IN (US); Ross G. Carl, River Forest, IL (US)

(73) Assignee: Kolcraft Enterprises, Chicago, IL (US)

( * ) Notice: Subject to any disclaimer, the term of this patent is extended or adjusted under 35 U.S.C. 154(b) by 39 days.

This patent is subject to a terminal disclaimer.

(21) Appl. No.: 12/977,470

(22) Filed: Dec. 23, 2010

(65) Prior Publication Data

US 2011/0092301 A1 Apr. 21, 2011

Related U.S. Application Data

(63) Continuation of application No. 11/885,733, filed as application No. PCT/US2006/008070 on Mar. 7, 2006, now Pat. No. 7,878,915.

(60) Provisional application No. 60/659,140, filed on Mar. 7, 2005.

(51) Int. Cl.
*A63G 13/02* (2006.01)

(52) U.S. Cl. ..... 472/119; 472/118

(58) Field of Classification Search ..... 472/119, 472/118

See application file for complete search history.

(56) References Cited

U.S. PATENT DOCUMENTS 342,855 A 6/1886 Abbey et al.
1,406,650 A 2/1922 Jones
2,023,235 A 12/1935 Count
2,697,477 A 12/1954 Welsh
2,698,477 A 12/1954 Welsh
3,146,985 A 9/1964 Grudoski
3,186,711 A 6/1965 Morrow
3,271,029 A 9/1966 Grudoski
3,759,539 A 9/1973 Goldberg
3,765,674 A 10/1973 Siler
4,022,510 A 5/1977 Saint
4,057,235 A 11/1977 Halopoff
4,138,104 A 2/1979 D'Amicis
4,150,820 A 4/1979 Bochmann
4,165,872 A 8/1979 Saint
D254,409 S 3/1980 Borucki
4,211,401 A 7/1980 Cunard
4,323,233 A 4/1982 Gebhard
4,324,432 A 4/1982 Eldon, III et al.
4,325,578 A 4/1982 Borucki
4,452,446 A 6/1984 Saint
4,491,317 A 1/1985 Bansal
4,616,824 A 10/1986 Quinlan, Jr. et al.

(Continued)

OTHER PUBLICATIONS

Restriction/Election Requirement, issued by the United States Patent and Trademark Office in connection with U.S. Appl. No. 11/885,733, on Oct. 1, 2010, 6 pages.

(Continued)

*Primary Examiner* — Michael Dennis
(74) *Attorney, Agent, or Firm* — Hanley, Flight & Zimmerman, LLC

(57) ABSTRACT

A child entertainment apparatus is convertible between a swing mode and a jumper mode. An example apparatus includes a frame, and a seat. The seat is coupled to the frame by a substantially rigid support when the apparatus is in the swing mode, and the seat is coupled to the frame through a substantially flexible support when the apparatus is in the jumper mode.

26 Claims, 21 Drawing Sheets

U.S. PATENT DOCUMENTS 4,688,850 A 8/1987 Brownlie et al.
D293,046 S 12/1987 Riehm
4,722,521 A 2/1988 Hyde et al.
4,785,678 A 11/1988 McGugan et al.
4,805,902 A 2/1989 Casagrande
4,822,033 A 4/1989 Kohus et al.
5,083,773 A 1/1992 Saint
5,342,245 A 8/1994 Webb, Jr.
5,378,196 A 1/1995 Pinch et al.
D368,368 S 4/1996 Mitchell et al.
D368,816 S 4/1996 Mitchell et al.
5,525,113 A 6/1996 Mitchell et al.
5,533,936 A 7/1996 Julien et al.
5,624,321 A 4/1997 Snyder
5,628,689 A 5/1997 Saint et al.
5,704,882 A 1/1998 Coates et al.
D392,126 S 3/1998 Sack
5,769,727 A 6/1998 Fair et al.
5,788,014 A 8/1998 Saint et al.
5,803,817 A 9/1998 Stern
5,816,983 A 10/1998 Dawes et al.
5,833,545 A 11/1998 Pinch et al.
5,846,136 A 12/1998 Wu
5,848,553 A 12/1998 Miyazaki
5,855,140 A 1/1999 Imamura
5,857,944 A 1/1999 Cone et al.
5,876,311 A 3/1999 Coates et al.
D412,067 S 7/1999 Wu
5,975,631 A 11/1999 Fair et al.
5,996,192 A 12/1999 Haines et al.
6,010,410 A 1/2000 Lauro et al.
6,022,277 A 2/2000 Jankowski
6,027,409 A 2/2000 Favorito et al.
6,059,667 A 5/2000 Pinch
D428,268 S 7/2000 Fair
6,193,224 B1 2/2001 Dillner et al.
6,260,833 B1 7/2001 Drager
6,273,505 B1 8/2001 Carnaham
6,283,870 B1 9/2001 Saint et al.
6,319,138 B1 11/2001 Fair et al.
6,339,304 B1 1/2002 Allison et al.
6,361,446 B2 3/2002 Lawson et al.
D456,189 S 4/2002 Flannery et al.
6,386,901 B1 5/2002 Caldwell
6,386,986 B1 5/2002 Sonner et al.
6,421,901 B2 7/2002 Sitarski et al.
6,428,098 B1 8/2002 Allbaugh
6,471,597 B1 10/2002 Flannery et al.
6,500,072 B1 12/2002 Myers et al.
6,511,123 B1 1/2003 Sitarski et al.
6,520,862 B1 2/2003 Armbruster et al.
6,544,128 B1 4/2003 Yang
6,561,915 B2 5/2003 Kelly et al.
6,626,766 B1 9/2003 Hsia
6,645,080 B1 11/2003 Greger et al.
6,666,473 B2 12/2003 Hartenstine et al.
6,666,505 B2 12/2003 Greger et al.
D485,690 S 1/2004 Hsia
D486,965 S 2/2004 Hsia
6,692,368 B1 2/2004 Hyun
6,702,685 B2 3/2004 Mahlstedt et al.
D490,993 S 6/2004 Longnecker et al.
6,824,472 B2 11/2004 Armbruster et al.
6,824,473 B2 11/2004 Wu
6,830,517 B1 12/2004 Ciraolo
6,857,700 B2 2/2005 Eastman et al.
6,857,966 B2 2/2005 Armbruster et al.
D503,055 S 3/2005 Longnecker et al.
6,872,146 B1 * 3/2005 Paesang et al. ..... 472/119
6,875,117 B2 4/2005 Ransil et al.
6,877,802 B2 4/2005 Christensen et al.
D504,791 S 5/2005 Longnecker et al.
6,887,161 B2 5/2005 Mahlstedt et al.
6,896,624 B2 5/2005 Longnecker et al.
6,902,489 B2 6/2005 Greger et al.
6,916,249 B2 7/2005 Meade
6,926,359 B2 8/2005 Runk
6,932,426 B2 8/2005 Greger
6,932,709 B1 8/2005 Gubitosi et al.
6,994,630 B2 * 2/2006 Paesang ..... 472/118
7,052,403 B2 5/2006 Ransil et al.
7,066,536 B2 6/2006 Williams et al.
7,081,052 B2 7/2006 Greger et al.
7,326,120 B2 2/2008 Bellows et al.
7,607,734 B2 10/2009 Clapper et al.
7,770,971 B2 8/2010 Bellows et al.
7,824,273 B2 11/2010 Clapper et al.
7,878,915 B2 2/2011 Myers et al.
7,883,426 B2 2/2011 Bellows et al.
2003/0067193 A1 4/2003 Asbach et al.
2003/0199329 A1 10/2003 Wood et al.
2004/0102252 A1 5/2004 Longnecker et al.
2004/0102253 A1 5/2004 Ransil et al.
2004/0198511 A1 10/2004 Greger et al.
2004/0198512 A1 10/2004 Ransil et al.
2004/0198513 A1 10/2004 Wood et al.
2004/0198515 A1 10/2004 Wood et al.
2004/0239163 A1 12/2004 Runk
2004/0259647 A1 12/2004 Wood et al.
2005/0014569 A1 1/2005 Greger et al.
2005/0059502 A1 3/2005 Greger et al.
2005/0125970 A1 6/2005 Nolan
2005/0127727 A1 6/2005 Gangadharan et al.
2005/0225157 A1 10/2005 Patrizi et al.
2005/0239565 A1 10/2005 Ransil et al.
2006/0096153 A1 * 5/2006 Jung ..... 43/18.1 R
2006/0194639 A1 8/2006 Greger et al.
2006/0214486 A1 9/2006 Ransil et al.
2006/0252564 A1 11/2006 Bellows et al.
2007/0111809 A1 5/2007 Bellows et al.
2007/0267904 A1 11/2007 Clapper et al.
2008/0217974 A1 9/2008 Velderman et al.
2009/0170618 A1 7/2009 Bellows et al.
2010/0201171 A1 8/2010 Velderman et al.

OTHER PUBLICATIONS

Notice of Allowance, issued by the Unied States Patent and Trademark Office in connection with U.S. Appl. No. 11/885,733, on Dec. 16, 2010, 10 pages.
International Preliminary Report on Patentability, issued by the International Preliminary Examining Authority in connection with International Application No. PCT/US06/08070, on Jul. 2, 2007, 7 pages.
International Search Report, issued by the International Seacrhing Authority in connection with International Application No. PCT/US06/08070, on Sep. 25, 2006, 3 pages.
Written Opinion, issued by the International Seacrhing Authority in connection with International Application No. PCT/US06/08070, on Sep. 25, 2006, 5 pages.
First Notification of Office Action, issued by the State Intellectual Property Office of China, in connection with Chinese Application No. 200680007334.5, on May 8, 2009, 4 pages.
2nd Notification of Office Action, issued by the State Intellectual Property Office of China, in connection with Chinese Application No. 200680007334.5, on Aug. 30, 2010, 4 pages.

* cited by examiner

CHILD SWING AND JUMPER APPARATUS AND METHODS OF OPERATING THE SAME

CROSS REFERENCE TO RELATED APPLICATION

This patent is a continuation of U.S. patent application Ser. No. 11/885,733, filed on Sep. 23, 2008, which is a continuation of PCT/US06/08070, which was filed Mar. 7, 2006, which claims priority from U.S. Provisional Application Ser. No. 60/659,140, filed Mar. 7, 2005, all of which are entitled "Child Swing and Jumper Apparatus and Methods of Operating the Same" and all of which are incorporated herein by reference in their entireties.

FIELD OF THE DISCLOSURE

This disclosure relates generally to child care products, and, more particularly, to child swing and jumper apparatus and methods of operating the same.

BACKGROUND

Infant swings of various types are known. One type of infant swing is an open top swing which, as its name suggests, does not include a bar or housing member above and across the seat. This opening above the seat facilitates inserting/removing an infant to/from the swing. Open top swings generally include a base or frame member which is disposed on the ground surface. A swing assembly is connected to and depends from the frame. The swing assembly is adapted to pivot relative to the frame assembly. The desired swinging movement is generated either manually or by a drive motor.

Infant jumpers of various types are also known. Some jumpers include a seat and spring supports for suspending the seat from a door frame or the like. A small child located in the seat can obtain exercise and entertainment by moving to cause the jumper to bounce within the door frame.

Bouncers which are constructed as reclined seats or bassinets are also known. These bouncers include a frame that positions the seat in a reclined position. The frame, which may be constructed of wire, experiences damped oscillatory movements when the child moves or when a care provider intentionally bounces the frame. Sometimes a mechanical vibrator is coupled to the frame to provide vibrations that can soothe or entertain an infant located in the bouncer.

In recent years, walker alternatives have been developed. Walker alternatives (sometimes referred to as bouncers, activity centers or child entertaining apparatus) generally include a base and a seat/sling that is suspended from a tray above the base. The tray is typically spaced a sufficient distance above the base such that the feet of a child seated in the seat/sling can reach the base to simulate standing. In some known walker alternatives, the tray is suspended above the base using adjustable columns to permit adjustment of the distance between the tray and the base to fit the height of the child.

The seats/slings of the known walker alternatives are typically rotatably suspended in the center of their trays such that the seats/slings are surrounded on all sides by their corresponding trays. Toys can be placed at various positions on the tray to encourage a child suspended in the seat/sling to use his/her legs to rotate themselves to reach the toys of interest. The bases of some known walker alternatives are cupped or bowled (e.g., semi-spherical) to permit rocking of the walker alternative. Some walker alternatives also suspend their trays, and, thus, their seats, using springs to permit bouncing of the tray, seat, and/or child.

DETAILED DESCRIPTION

Figure 1:
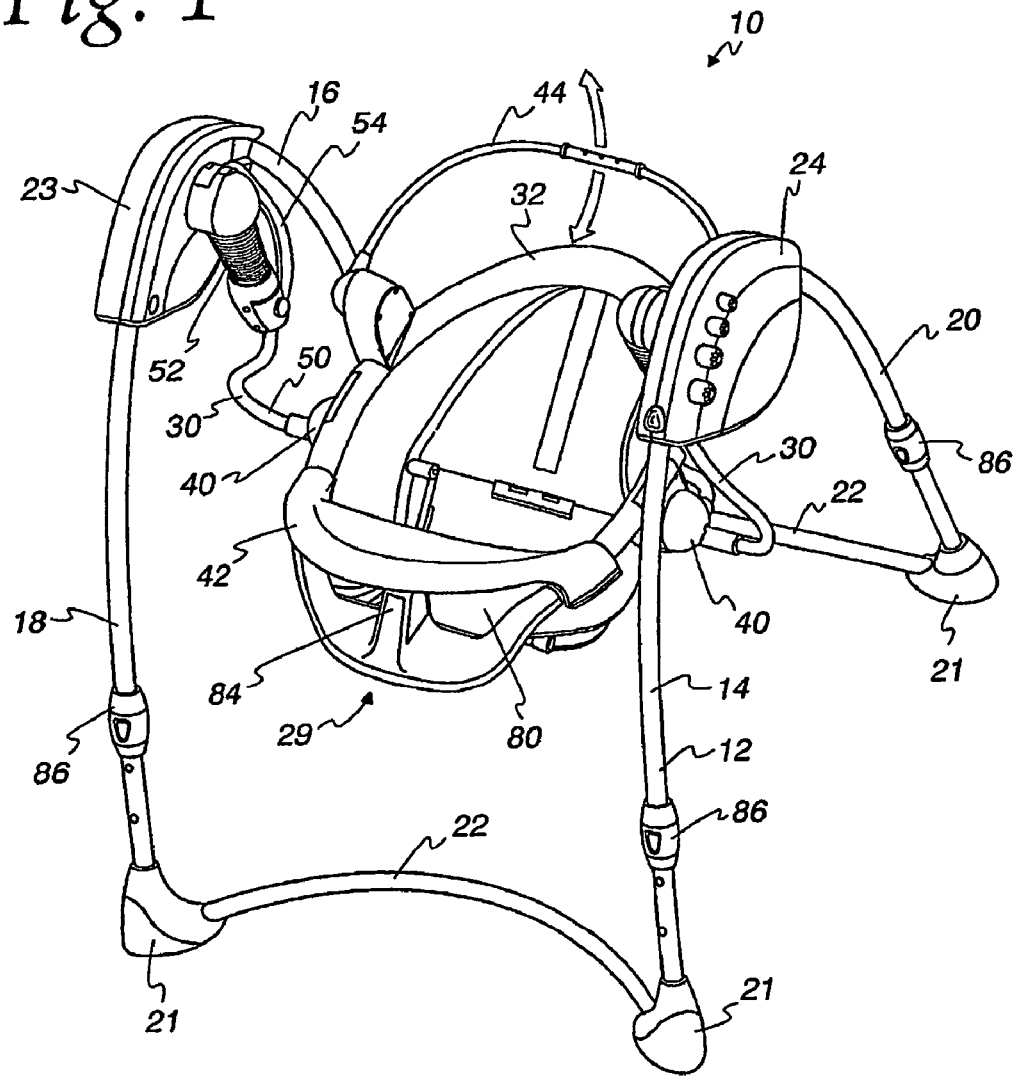
FIG. 1 is a perspective view of an example child swing and jumper apparatus constructed in accordance with the teachings of the invention and showing the apparatus in a swing mode.

FIG. 1 is a perspective view of an example child swing and jumper apparatus 10 constructed in accordance with the teachings of the invention. The apparatus 10 of the illustrated example has two modes of operation. In a first mode, the apparatus 10 is operable as an infant swing. In a second mode, the apparatus 10 is operable as a jumper.

In the illustrated example, the apparatus 10 is provided with a free standing frame 12. The frame 12 of the illustrate example comprises plastic or metal tubular frame legs 14, 16, 18 and 20. Also, in the illustrated embodiment, the frame 12 is an open top frame (i.e., there is no top cross-bar). The bottom end of each leg 14, 16, 18, 20 is fastened to one end of a respective connector 21. The remaining end of each connector 21 is fastened to a respective base member 22. Each of the connectors 21 and/or the two base members 22 are adapted to seat on the ground surface to support and stabilize the apparatus 10. It will be appreciated by one of ordinary skill in the art that the legs 14, 16, 18, 20, the connectors 21, and the base members 22 may each be manufactured in any number of connectable parts, including, for example, a single unitary design, and may alternatively be combined as desired. Moreover, each connector 21 may alternatively be clipped, snapped to, coupled to, or otherwise held to each leg 14, 16, 18, 20, and base member 22.

Two of the frame legs 16 and 18 converge at their respective top leg ends and are mounted to and/or in a housing 23. Similarly, the other two frame legs 14 and 20 converge at their respective top leg ends and are mounted to and/or in a housing 24. In the example apparatus illustrated in FIG. 1, the housing 24 also serves to house a swing motor 90 (see FIGS. 10 and 11) which, as described below, when actuated, drives a seat assembly through a swinging motion such as, for example, a generally arcuate motion, or a generally linear motion such as a generally horizontal plane. If desired, the swing motor 90 can be incorporated into or can be external of the housing 24. Further, the swing motor 90 can be powered by batteries or electrical power. Alternatively, the motion can be applied by a wind-up spring mechanism. Still further, the apparatus 10 may not include any swing drive mechanism, but instead may be limited to manual swinging.

In the illustrated example, a convertible swing and jumper assembly 29 is pivotably suspended from the housings 23, 24. The assembly 29 of the illustrated example includes two arms 30 and a seat 32. Each of the arms has a top pivotably mounted to a respective one of the housings 23, 24. Although the illustrated example includes two arms 30, persons of ordinary skill in the art will appreciate that other number or arms (e.g., 1, 3, 4, etc.) may alternatively be used.

The seat 32 is pivotably suspended between the arms 30. The seat 32 of the illustrated example is molded from at least one plastic member. In the illustrated example, the seat 32 is at least partially covered by a fabric covering 33 to provide cushioning and comfort for an occupant of the seat (see FIG. 7).

In the illustrated example, the apparatus 10 includes two pivot assemblies 40. Each pivot assembly 40 fastens the seat 32 to a respective one of the arms 30. The pivot assemblies 40 may be adjusted to incline the seat 32 between a plurality of positions, including, for example, an upright position and a reclined position. Any number of positions intermediate the upright and reclined positions may likewise be appropriate. Alternatively, the pivot assemblies 40 can be eliminated in favor of a fixed connector between the seat 32 and the arm 30.

Figure 12:
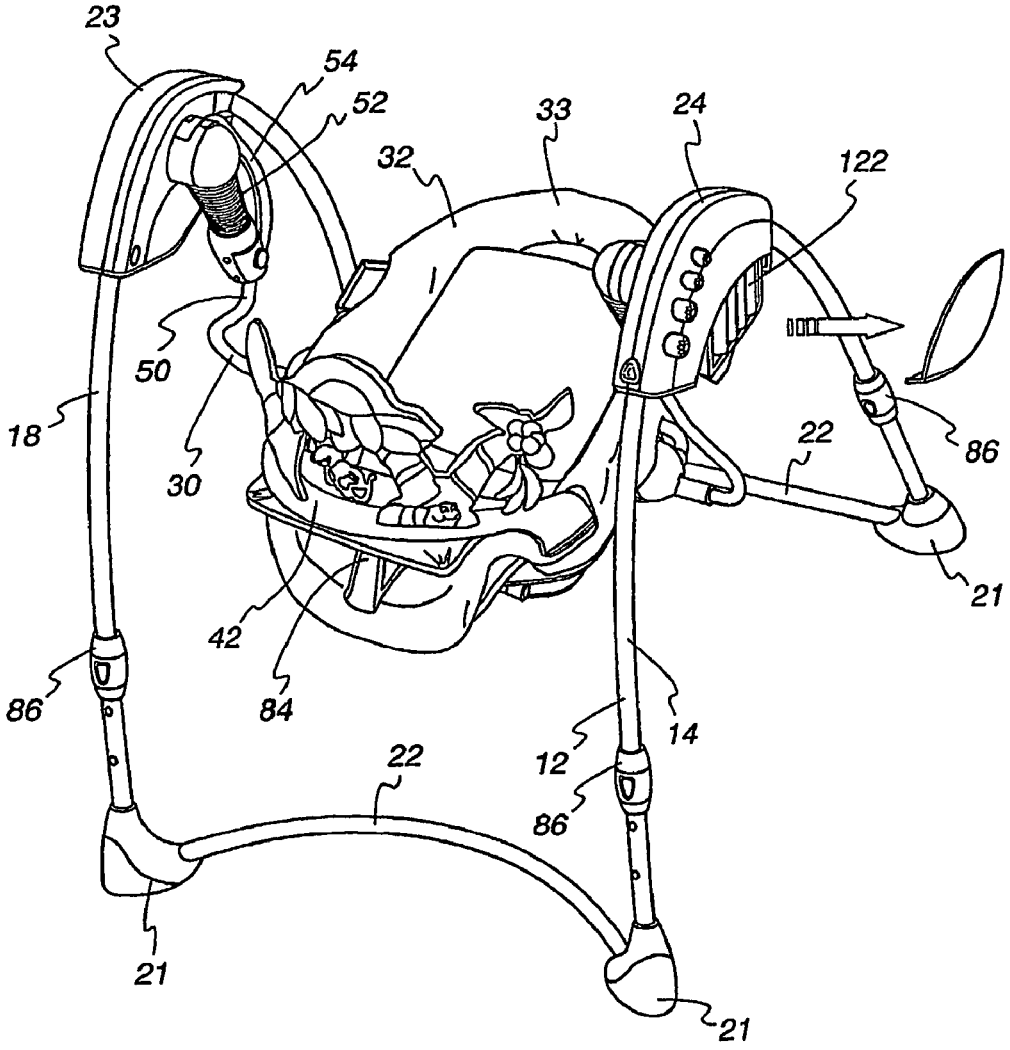
FIG. 12 is a perspective view of another example child swing and jumper apparatus constructed in accordance with the teachings of the invention and showing the apparatus in a swing mode.

In order to support food, toys, and/or other items in front of a child seated in the seat 32, the apparatus 10 is further provided with a conventional tray 42. For example, as illustrated in FIG. 12, the tray 42 may be used to support one or more toys. The tray 42 may further be removably and/or pivotally mounted to the seat 32 (see FIGS. 2 and 3). In the illustrated example, the tray 42 is removed from the seat 32 when the seat 32 is in the jumper mode (see FIG. 3 and FIG. 7), but may be reattached as desired. Additionally or alternatively, the seat 32 may be provided with a pivotable swing bar 44, which may also be utilized to support items, such as, for example, toys, lights, a canopy, and/or other item.

Figure 4:
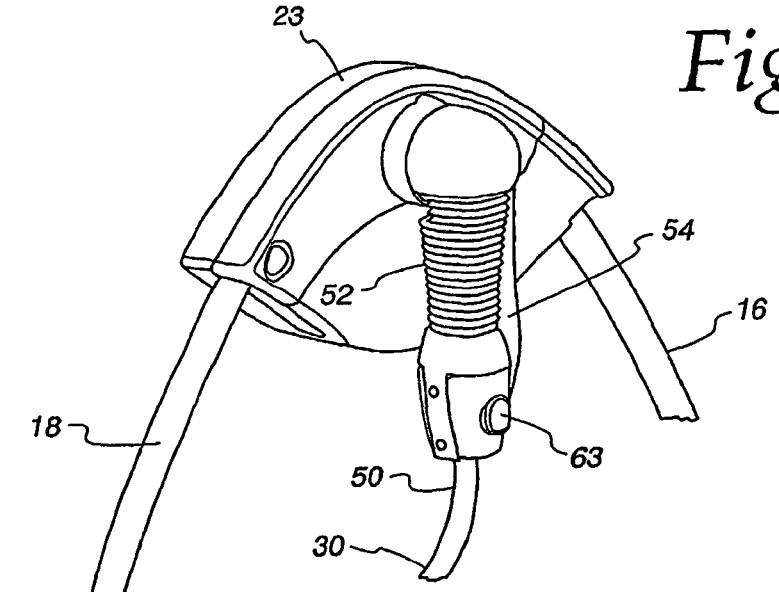
FIG. 4 is an enlarged view of one of the two bypass connectors of FIG. 1 showing the bypass connector in the engaged position.
Figure 5:
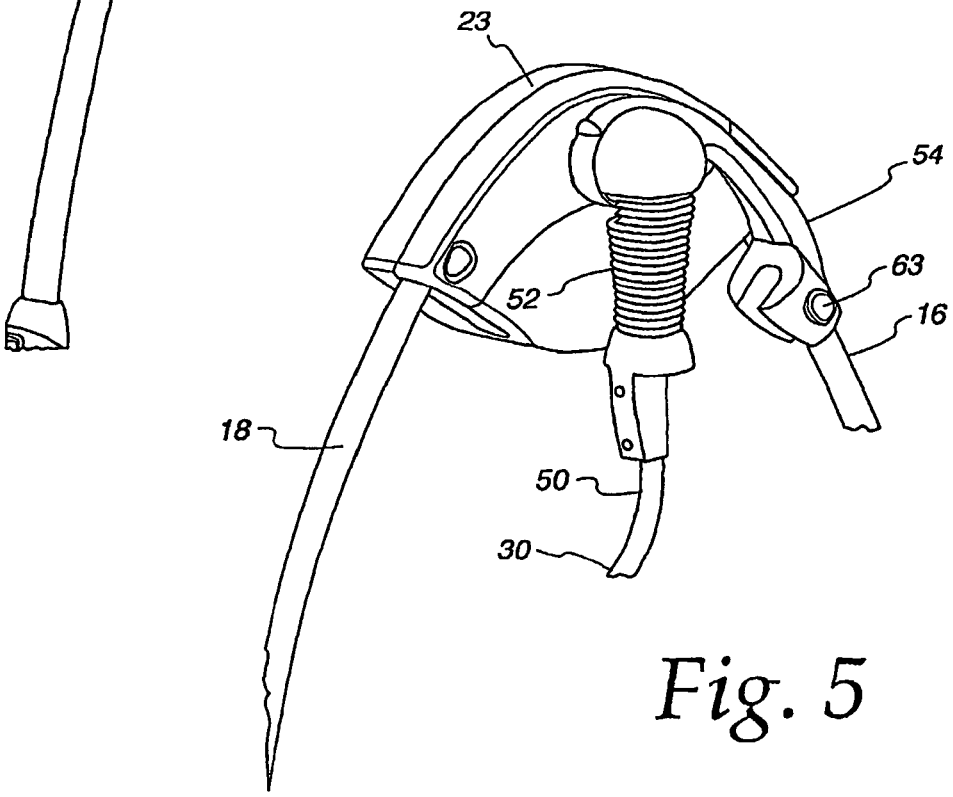
FIG. 5 is an enlarged view of one of the two bypass connector of FIG. 1 showing the bypass connector in the disengaged position.

To facilitate conversion between the swing mode and the jumper mode, the arms 30 of the illustrated example are implemented by suspending means such as, for example, the illustrated convertible members 30 having a first mode wherein the seat is suspended for operation as a swing and a second mode wherein the seat is suspended for operation as a jumper. Each arm/convertible member 30 is structured to function as a substantially rigid support and as a substantially flexible support. To that end, each of the arms 30 includes a rigid section 50, a flexible section 52, and a bypass connector 54. In the illustrated example, each bypass connector 54 is implemented by a rigid member having a first end pivotably coupled above the flexible section 52 to a respective hub and/or one of the housings 23, 24 and a free end which may be selectively connected to the rigid section 50 below the flexible section 52. Further, each bypass connector 54 is pivotable relative to its respective arm 30 between a secured, or engaged position (see FIG. 4) and a released or disengaged position (see FIG. 5). When the bypass connector 54 is in the engaged position, it provides a rigid connection between its respective hub/housing 23 or 24 and the rigid section 50 of its respective leg 30. As a result, forces are transferred through the bypass connector 54 (not through the flexible section 52) so that the flexible section 52 is not functional and the arm 30 is, then, substantially rigid. In this way, the flexible section is effectively removed from the arm 30. Thus, when the bypass connector 54 is in the engaged position, the seat 32 is rigidly suspended from the housings 23, 24 and, accordingly, the apparatus 10 is configured to function as a swing when motion is imparted to the seat 32. In other words, the seat 32 has a fixed suspension height at the dead stop, lowest point in the swing path relative to the frame 12. That fixed height depends on the length of the arms/convertible member when the bypass connectors 52 are in the engaged position.

When, on the other hand, the bypass connector 54 is in the disengaged position (see FIG. 4), the flexible section 52 is permitted to flex, extend and/or contract, and the seat 32 is, thus, suspended from the flexible sections 52 of the arms 30. As a result, the effective length of each of the arms 30 is variable such that the seat 32 may be bounced relative to the housings 23, 24 by an occupant of the seat.

Figure 6:
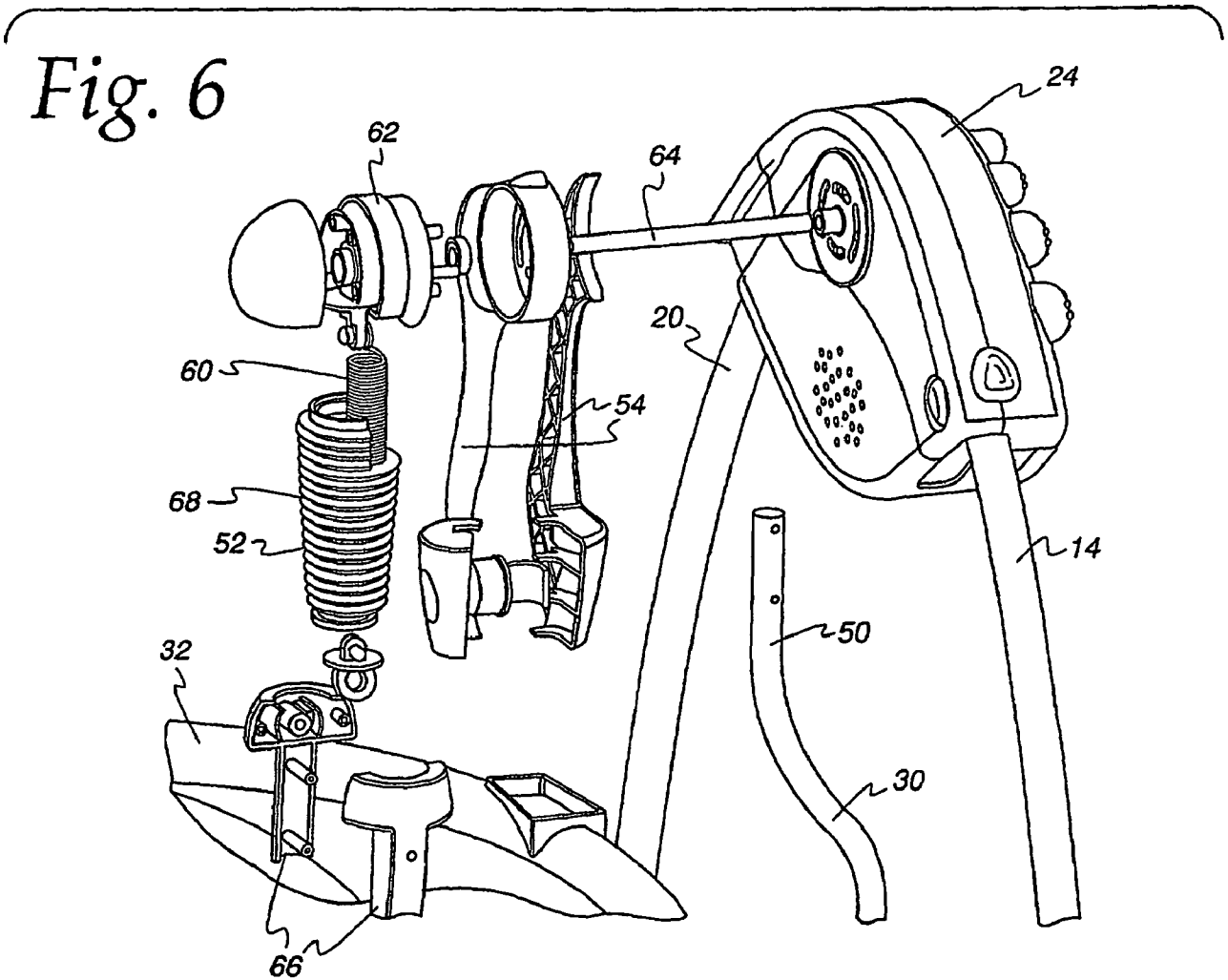
FIG. 6 is an exploded perspective view of one of the example bypass connectors of FIG. 1.

FIG. 6 illustrates one example convertible arm 30. In the illustrated example, the flexible section 52 of the arm 30 includes at least one spring 60 operatively coupled at one end to a hub 62, which is pivotally mounted to the housing 24 via an axle 64. Specifically, the hub 62 is journalled on the axle 64 for rotating motion. The other end of the spring 60 is operatively coupled to the rigid section 50 of the arm 30 through a spring coupling 66. The spring 60 of the illustrated example is at least partially covered by a protective cover 68 to reduce pinch points sometimes associated with the use of a spring. Additionally, it will be appreciated by one of ordinary skill in the art that the spring 60 may be replaced and/or supplemented by any suitable flexible material and/or device, including for example, a bungee cord, elastic band, and/or other suitable material.

Furthermore, in the illustrated example, one end of the spring 60 is pivotally coupled to the hub 62, while the other end of the spring is pivotally coupled to the spring coupling 66. For instance, each end of the spring 60 may include a spring loop to engage a fixed pin, and or other extension, allowing the spring to pivot relative the pin. Accordingly, the spring 60 may pivot relative the hub 62 and/or the spring coupling 66 to provide a greater range of movement.

In the illustrated example, the bypass connector 54 is journalled on the axle 64 between the hub 62 and the housing 24. In this example, the bypass connector 54 is pivotally attached around the circumference of the hub 62. As previously disclosed, when the bypass connector 54 is in the engaged position (FIG. 4), it provides a rigid connection between the hub 62 and the rigid section 50 of the arm 30. In the illustrated example, the bypass connector 54 is removably attached to the spring coupling 66 to secure the bypass connector 54 in the engaged position. In particular, the bypass connector 54 defines a slot or receptacle sized to receive a cylindrical stem of the spring coupling 66. When in the disengaged position (FIG. 6), the bypass connector 54 is detached from the spring coupling 66, thereby freeing the flexible section 52 for expansion and compression to thereby provide a flexible connection between the hub 62 and the rigid section 50 of the arm 30. Conversely, when in the engaged position, the bypass connector 54 provides a rigid link between the stem of the spring coupling 66 and the hub 62, thereby precluding expansion and/or compression of the flexible section 52. This rigid link ensures the arm 30 maintains a fixed distance between the hub 62 and the pivot assembly 40 joining the seat 32 to the arm 30.

In the illustrated example, the bypass connector 54 includes an actuator 63. In particular, the actuator 63 is adapted to securely maintain a positive connection between the bypass connector 54 and the spring coupling 66 when the bypass connector 54 is in the engaged position. The actuator 63 may be biased such that an operator must depress or other deactivate the actuator 63 to release the bypass connector 54 from the spring coupling 66. In the illustrated example, the actuator 63 is located proximate the spring coupling 66. It will be appreciated, however, that the actuator may be located in any suitable location, including for example, on the link portion of the bypass connector 54, on the hub 62, on the spring coupling 66, or in any other suitable location. Still further, in the illustrated example, the bypass connector 54 may be secured in the disengaged position by the housing 23 by a mechanical fastener (not shown). For example, the bypass connector 54 may engage a snap-tab, a groove and detent, or other releasable connection to substantially prevent the bypass connector from accidentally moving to the engaged position.

Figure 8:
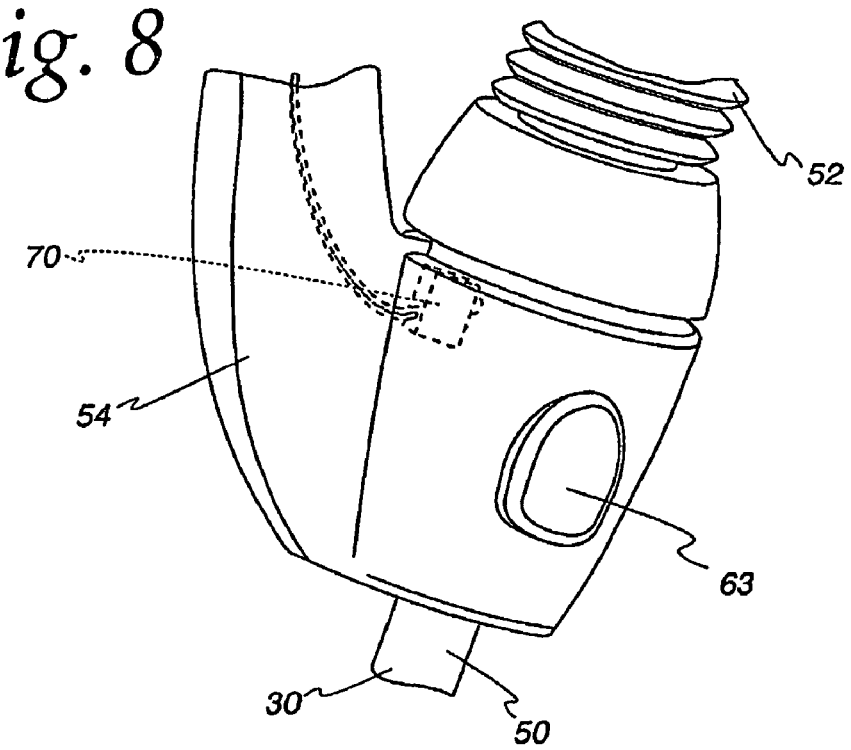
FIG. 8 is an enlarged view of one of the example bypass connectors of FIG. 1 showing a switch responsive to the position of the bypass connector.
Figure 9:
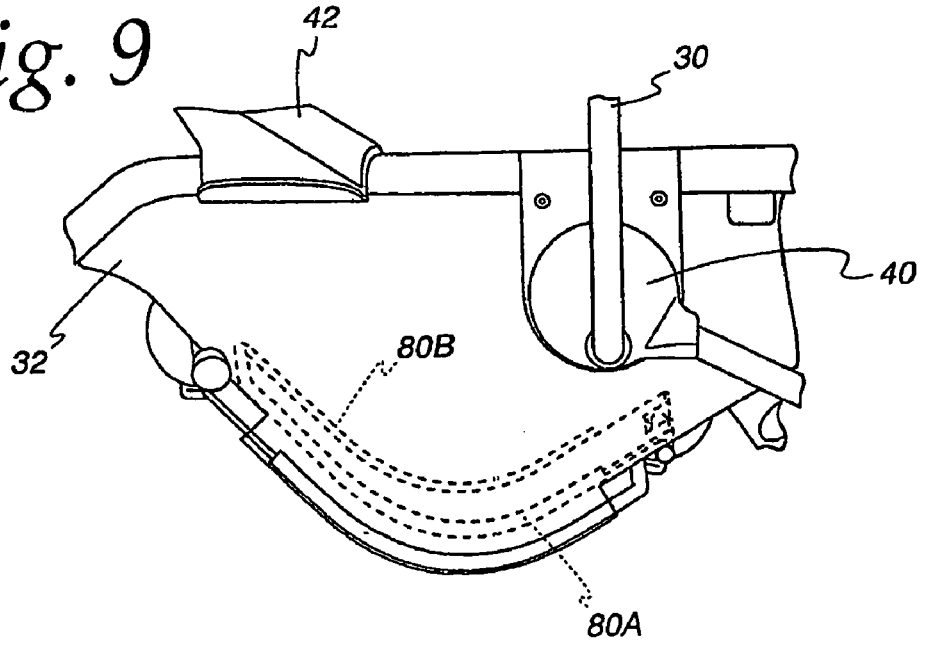
FIG. 9 is an enlarged view of the seat of FIG. 1 showing the seat in the swing mode.

The hub 62 is pivotally coupled to the housing 24 so that an electrically powered and/or mechanically powered swing motor may impart motion to the hub 62, and accordingly to the seat 32. As illustrated in FIG. 8, the bypass connector 54 of this example is positioned to engage a switch 70 to disable (e.g. preclude operation of) the motor when the apparatus 10 is in the jumper mode.

Figure 2:
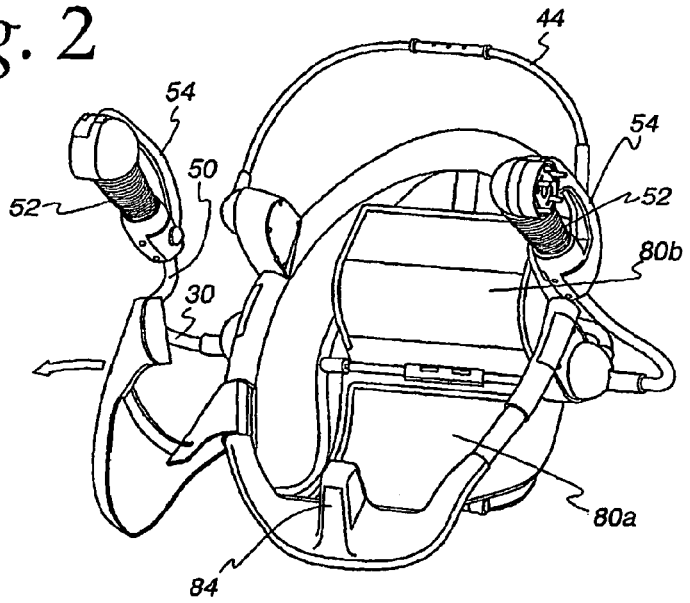
FIG. 2 is an enlarged view of the seat of FIG. 1 showing the seat during conversion between the swing mode and a jumper mode.
Figure 3:
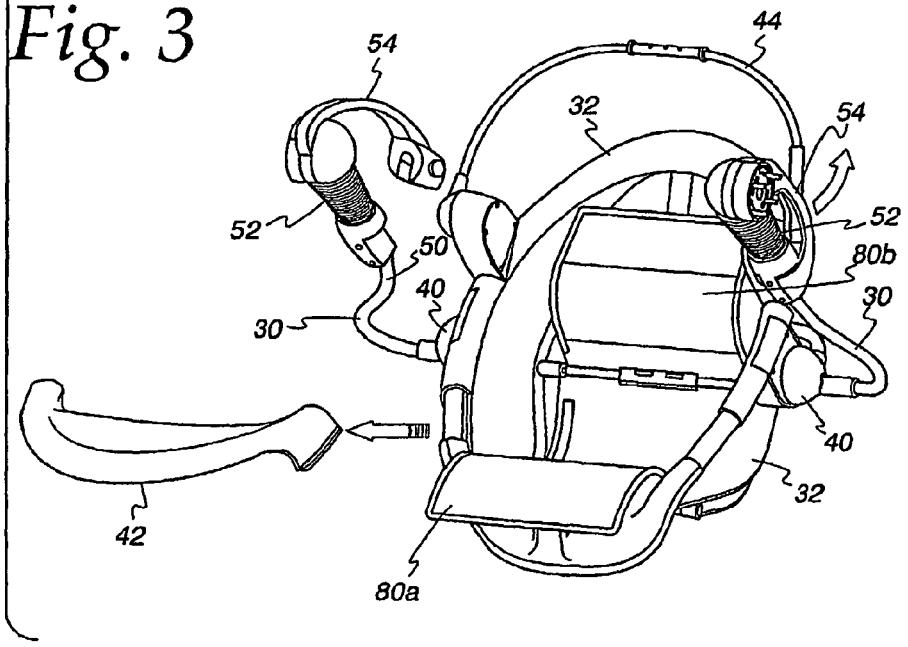
FIG. 3 is an enlarged view of the seat of FIG. 1 showing the seat in the jumper mode.
Figure 7:
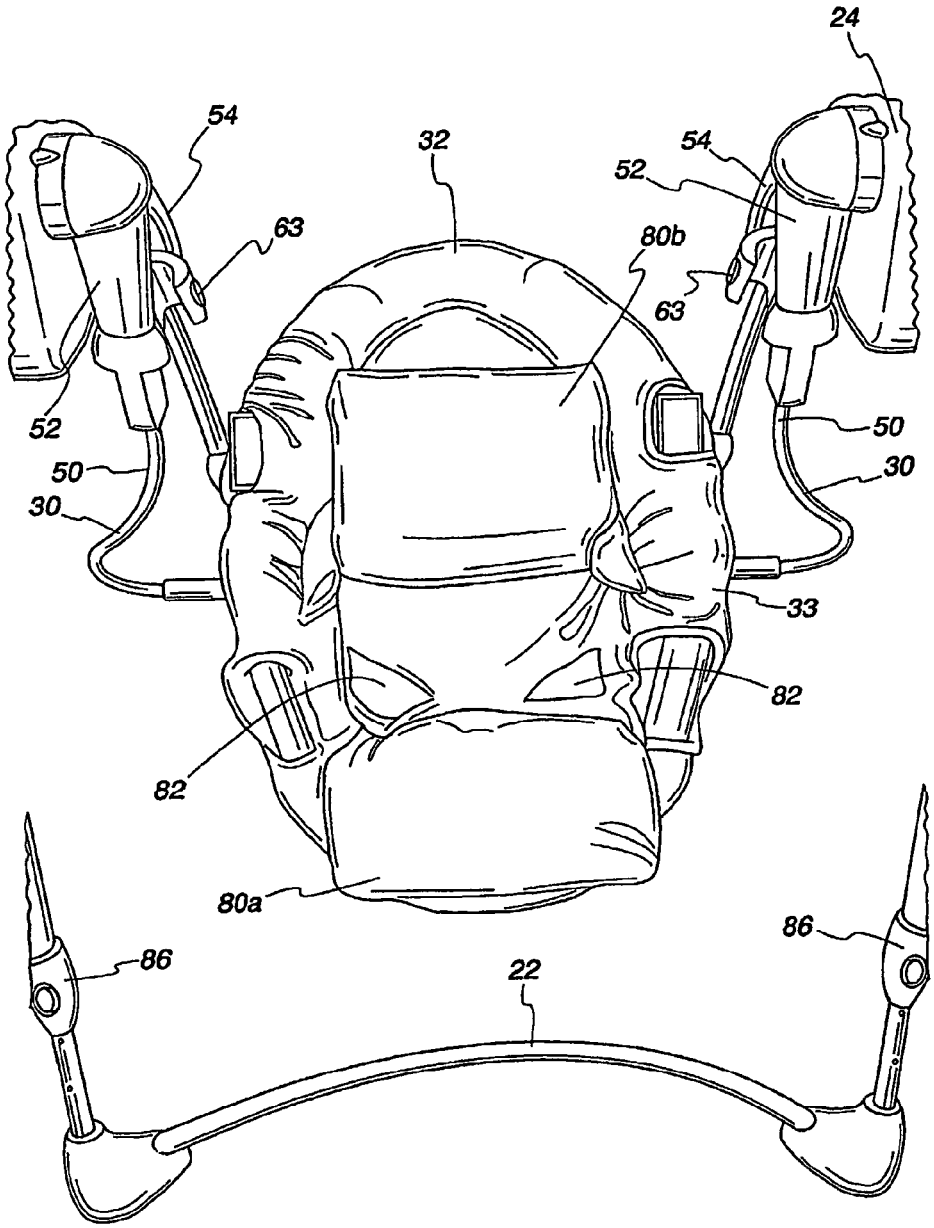
FIG. 7 is an enlarged perspective view of the apparatus of FIG. 1, but showing the apparatus in the jumper mode.

In the illustrated example, the seat 32 is provided with a shell and a movable seat bottom 80. For example, in the illustrated example, the seat 32 includes a first pivotable seat bottom panel 80A and a second pivotable seat bottom panel 80B. It will be appreciated by one of ordinary skill in the art that the seat bottom 80 may be implemented with any number of individual panels, including, for instance, a single panel. Still further, the seat bottom 80 may be constructed of a substantially rigid material (e.g., a plastic), or a substantially flexible material (e.g., a padded or unpadded cloth material) as desired. In this example, the pivotable seat bottom panel 80A is pivotably coupled to the front of the shell of the seat 32, and the second pivotable seat bottom panel 80B is pivotably coupled to a mid-portion of the shell of the seat 32 in overlying relation to the first seat bottom panel 80A. Moving the panels 80A, 80B between their lowered position and their raised position converts the seat 32 between a feet forward position for use when the apparatus 10 is configured as a swing (see FIG. 1) and a feet down position for use when the apparatus 10 is configured as a jumper (see FIG. 7). To this end, the shell of the seat 32 and/or the fabric covering 33 defines leg openings 82 in its base to receive the legs of a child standing within the seat 32. These leg openings are covered or substantially covered by the seat bottom panels 80A, 80B when the seat bottom panels are in the position of FIG. 1. As a result, an occupant of the seat 32 must be positioned with their feet in a forward position (e.g., with one leg on either side of the divider 84 which functions as a restraint). When, however, the seat bottom panels 80A, 80B are pivoted to their raised positions as shown in FIGS. 2, 3, and 7, the leg openings 82 are exposed, and a child's legs may be inserted through an opening defined in the shell of the seat 32 such that a child is suspended in the seat 32 with his/her feet touching the ground for jumping and/or bouncing. Additionally, as illustrated in FIG. 7, each of the panels 80A, 80B may include padding on at least a portion of the underside of the panels 80A, 80B, and exposed to a child whose legs are inserted through the openings defined in the shell of the seat 32.

As mentioned above, in the illustrated example, the seat 32 includes a leg divider 84 to act as a child restraint when the apparatus 10 is used as a swing. In some examples (not shown), the leg divider 84 is attached to the top surface of the seat bottom panel 80A. The user is recommended to pivot the seat 32 of the illustrated example into a generally reclined position via the pivot assemblies 40 when the apparatus 10 is employed in the jumper mode of FIG. 7.

In operation, as illustrated in FIGS. 2-5, the apparatus 10 may be easily converted from the swing mode (FIG. 1) to the jumper mode (FIG. 7) and vice versa. To switch from the swing mode to the jumper mode, each of the seat bottom panels 80A, 80B is rotated from its lowered position to its raised position to expose the leg openings 82 in the seat 32, which in this example are formed by the fabric covering 33. Forming the leg openings 82 in the fabric is advantageous because the child cannot fall through the larger opening found in the seat shell while providing support and padding to the child's anatomy. The bypass connectors 54 are released from the spring couplings 66 and rotated away from the flexible sections 52 so that the flexible sections 52 are active (i.e., the length of the arms 30 are variable). A child may now be inserted into the seat 32 with his/her legs extending through the holes 82 in the seat bottom such that the flexible sections 52 will amplify jumping and/or bouncing movements of the child.

In the illustrated example, the frame 12 includes at least one adjustable frame member 86 to vary the height of the frame 12 and to provide a plurality of selectable jumping and/or swinging heights. This height adjustability ensures that the seat 32 can be suspended at a suitable height to enable the feet of children of different sizes to reach the floor in the jumper mode.

To convert the apparatus 10 into the swing mode, the child is removed from the seat 32 and the seat bottom panels 80A, 80B, are pivoted to their lowered positions of FIG. 1 (i.e. overlapping relation covering the leg openings 82). Also, the bypass connectors 54 are rotated into their engaged positions (FIG. 4) so that the flexible sections 52 are inactive. If the disable switch 70 (see FIG. 8) is utilized, at least one of the bypass connectors 54 enables a motor in the engaged position. A child may then be placed in the seat 32 for swinging motion (e.g., powered motion in an electrical or mechanical motor is enabled).

Figure 10:
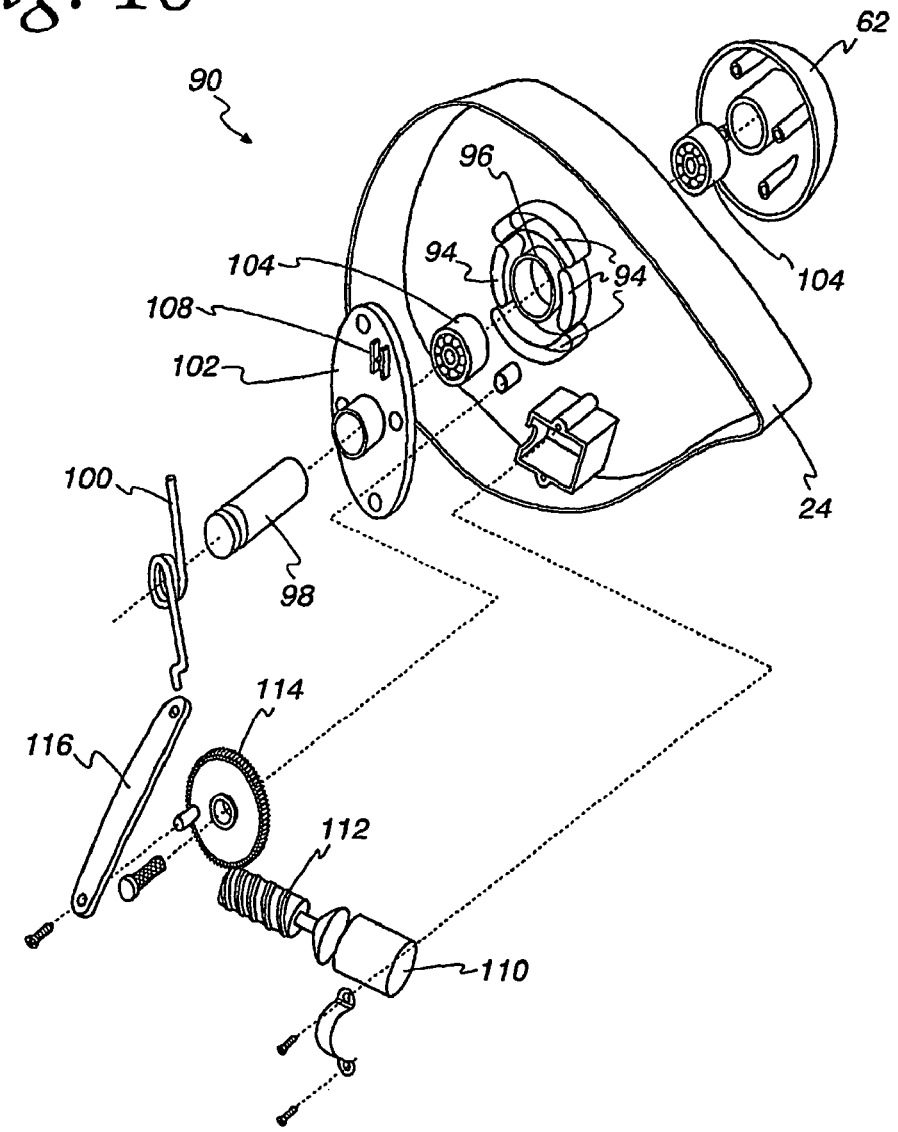
FIG. 10 is an exploded perspective view of an example motor that may be utilized in the apparatus of FIG. 1.
Figure 11:
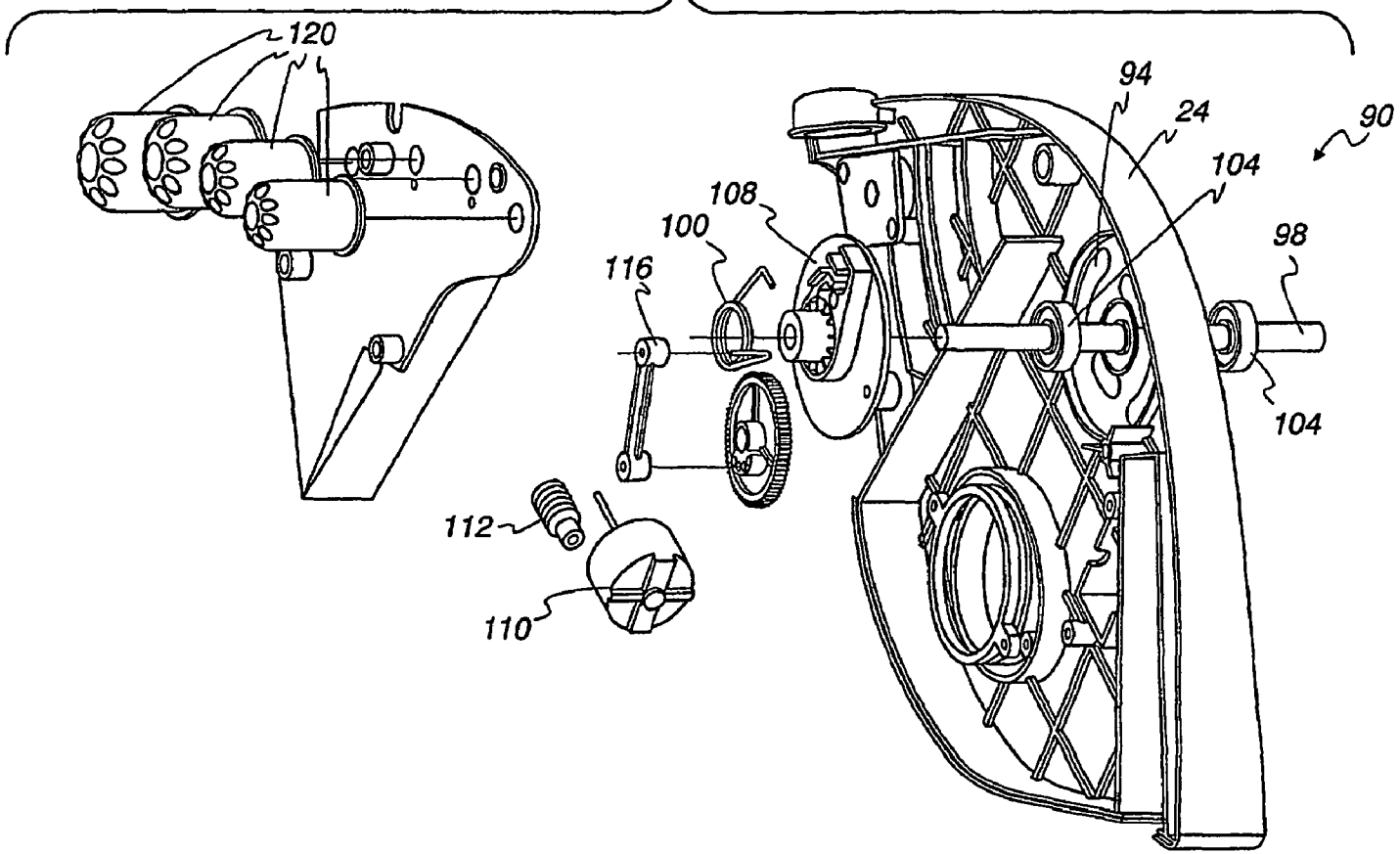
FIG. 11 is an exploded perspective view of an example motor that may be utilized in the apparatus of FIG. 1.

FIGS. 10 and 11 are two exploded perspective views of example swing motors 90 that may be configured to drive the seat 32 when the apparatus 10 is in the swing mode. In the illustrated examples, the swing motor 90 is provided in a housing 23, 24 defining a plurality of preformed channels 94 and an axle opening 96 holding a fixed axle 98. Pivotally mounted to the axle 98 is a drive spring 100, a drive plate 102, a pair of pivot bearings 104, and a hub 62. The drive spring 100 may be coupled to the drive plate 102 via a channel 108, formed, in this example on the surface of the drive plate 102. There may be lost motion between the spring 100 and the channel 108. The drive plate 102 also may include a plurality of projections (not shown) to extend at least partially into the channels 94, to limit and/or guide the motion of the drive plate 102 and mate with projections in the hub 62.

To move the drive spring 100, the drive plate 102, and the swing arm 106, the drive spring is coupled to a motor 110. In the illustrated example, the motor 110 is coupled to a worm gear 112 to rotatably drive the worm 112. The worm gear 112, in turn, is operatively coupled to a planetary gear 114 rotatably mounted to the housing 24. A link arm 116 includes a first end pivotally mounted to a carrier on the periphery of the planetary gear 114 and a second end coupled to the drive spring 100 for pivoting the drive spring 100 about the axle 98. There may be lost motion between the link 116 and the spring 100. The rotation of the motor 110 translates into a generally arcuate swing motion of the hub 62.

FIG. 11 shows an alternative motor construction which operates similarly to the motor of FIG. 10. Like parts have been numbered with like reference numbers in FIGS. 10 and 11 to facilitate understanding of the same.

The swing motor 90 may include a plurality of user operable buttons 120 that may be used to set a variety of operating conditions such as, for example, the speed or period of swinging motion, music and/or lighting associated with the apparatus 10, and/or any other operating parameter. Additionally, as illustrated in FIG. 12, the motor may be powered by an internal power supply such as batteries 122, or alternatively a typical household electrical outlet (not shown).

Figure 13A:
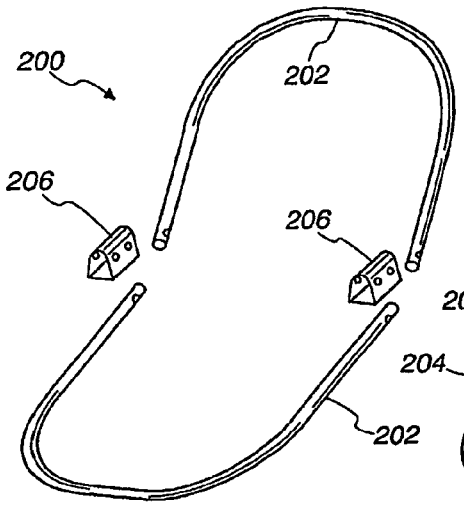
FIGS. 13A-13D are perspective views of an alternative example seat that may be utilized in the apparatus of FIG. 1.
Figure 13B:
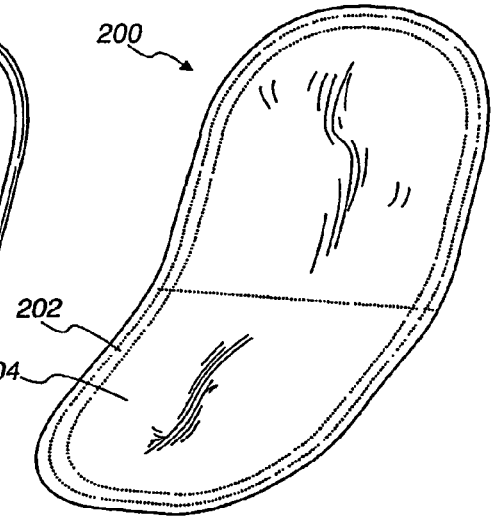
Figure 13C:
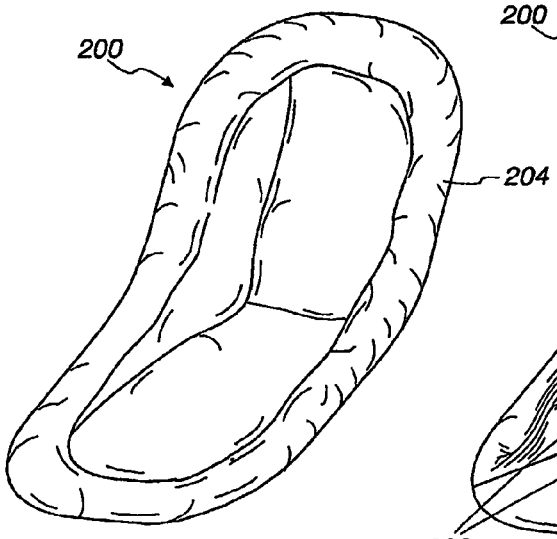
Figure 13D:
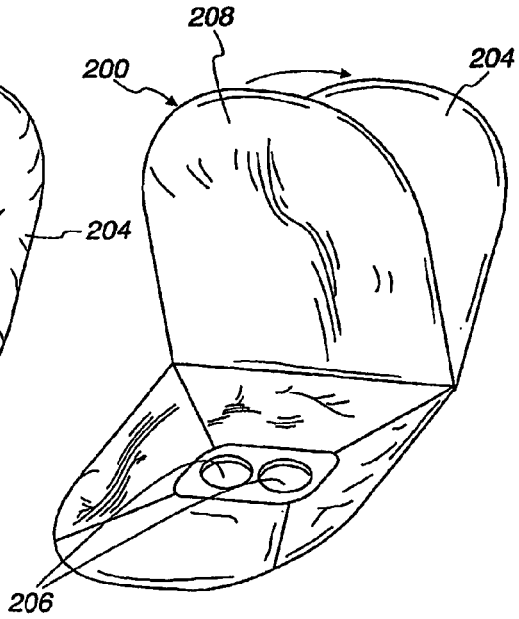

FIGS. 13A-13D illustrate an alternative example of a convertible swing/jumper seat 200 that may be used in conjunction with the apparatus 10. In this example, the seat 200 includes a frame such as, for example, at least one peripheral metal tube 202 having soft fabric 204 suspended between the peripheral tubes 202. The seat 200 may be reclined by use of a pivot connectors 206 and a release system (not shown), such as a cable lock release. In a swing operating mode (see FIG. 13C), a child may be placed in the seat 200 in a feet forward position. To configure the seat as a jumper (see FIG. 13D), the seat 200 and/or the soft fabric 204 defines leg openings 206 in its base to receive the legs of a child standing within the seat 200. In this example, the leg openings 206 are covered or substantially covered by a soft fabric layer 208. The forward edge and/or other portion of the soft fabric layer 208 may be releasably attached to the seat pad and/or the seat back via elastic, hook and loop fastener, and/or any other suitable connector to secure the layer 208 in the position of FIG. 13C and/or in the raised position. An intermediate position is shown in FIG. 13D. In the illustrated example, the seat 200 is pivoted into a generally reclined position when the apparatus 10 is employed in the jumper mode.

Additionally, a mechanical vibrator (not shown) may be coupled to the frame to provide vibrations that can soothe or entertain an infant located in the seat 200 in either the jumper or the swing mode.

Figure 14:
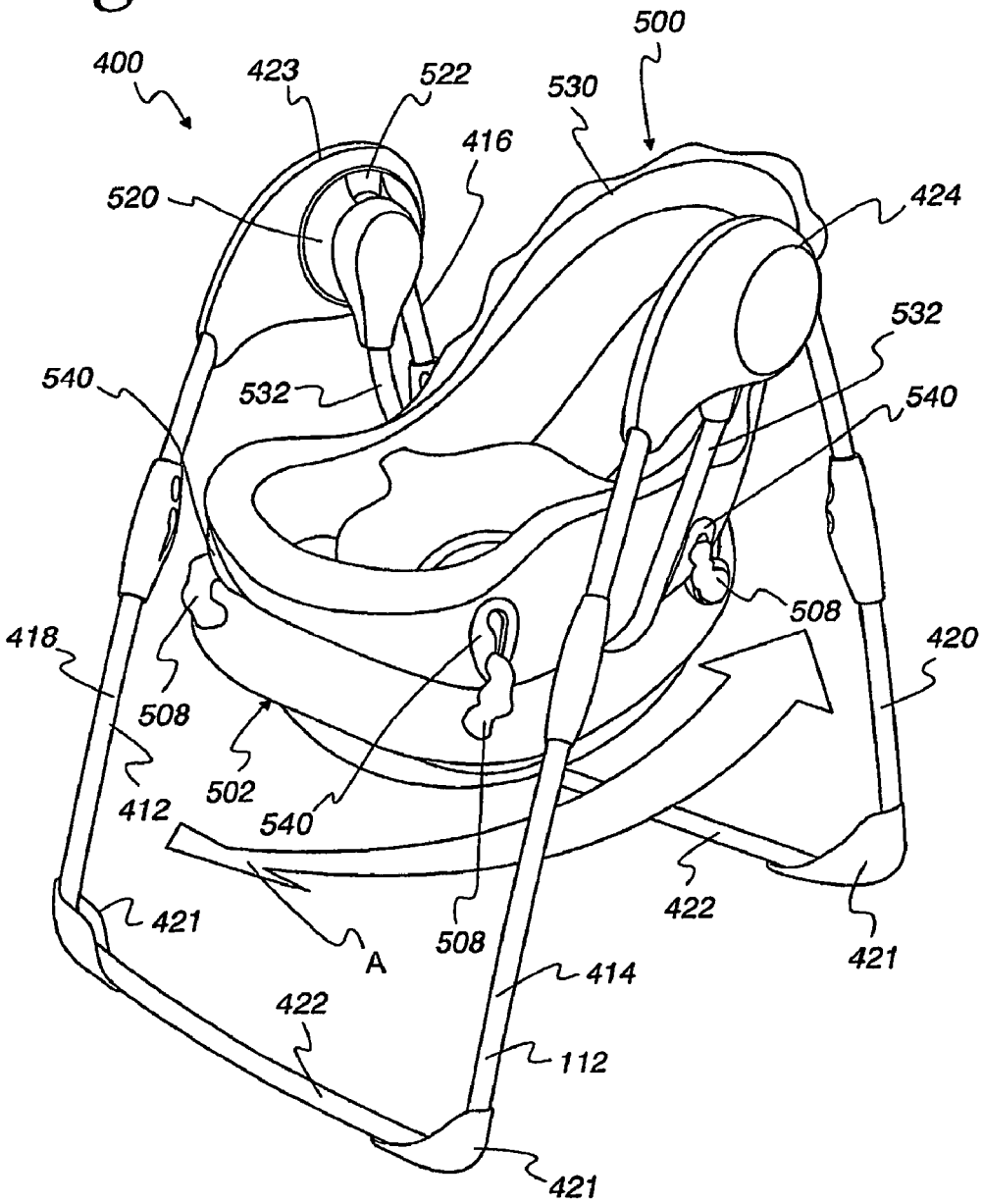
FIG. 14 is a perspective view of an alternative example child swing and jumper apparatus constructed in accordance with the teachings of the invention and showing the apparatus in a swing mode.

FIG. 14 is a perspective view of an alternative example child swing and jumper apparatus 400 constructed in accordance with the teachings of the invention. Like the apparatus 10, the apparatus 400 of the illustrated example has two modes of operation. In a first mode (see FIG. 14), the apparatus 400 is operable as an infant swing. In a second mode (see FIG. 16), the apparatus 400 is operable as a jumper.

In the illustrated example, the apparatus 400 is provided with a free standing frame 412. The frame 412 of the illustrate example comprises plastic or metal tubular frame legs 414, 416, 418 and 420. The frame 412 is an open top frame (i.e., there is no top cross-bar). The bottom end of each leg 414, 416, 418, 420 is fastened to one end of a respective connector 421. The remaining end of each connector 421 is fastened to a respective base member 422. Each of the connectors 421 and/or the base members 422 are adapted to seat on the ground surface to support and stabilize the apparatus 400.

Frame legs 416 and 418 converge at their respective top leg ends and are mounted in a housing 423. Similarly, legs 414 and 420 converge at their respective top leg ends and are mounted in a housing 424. In the example apparatus 400 illustrated in FIGS. 14-16, at least one of the housings 423, 424 also serves to house a swing motor which, when actuated, drives a seat assembly through arcuate motion as indicated by the arrow A. The motor can be powered by a wind-up spring mechanism or a DC or AC current based mechanism.

Figure 15:
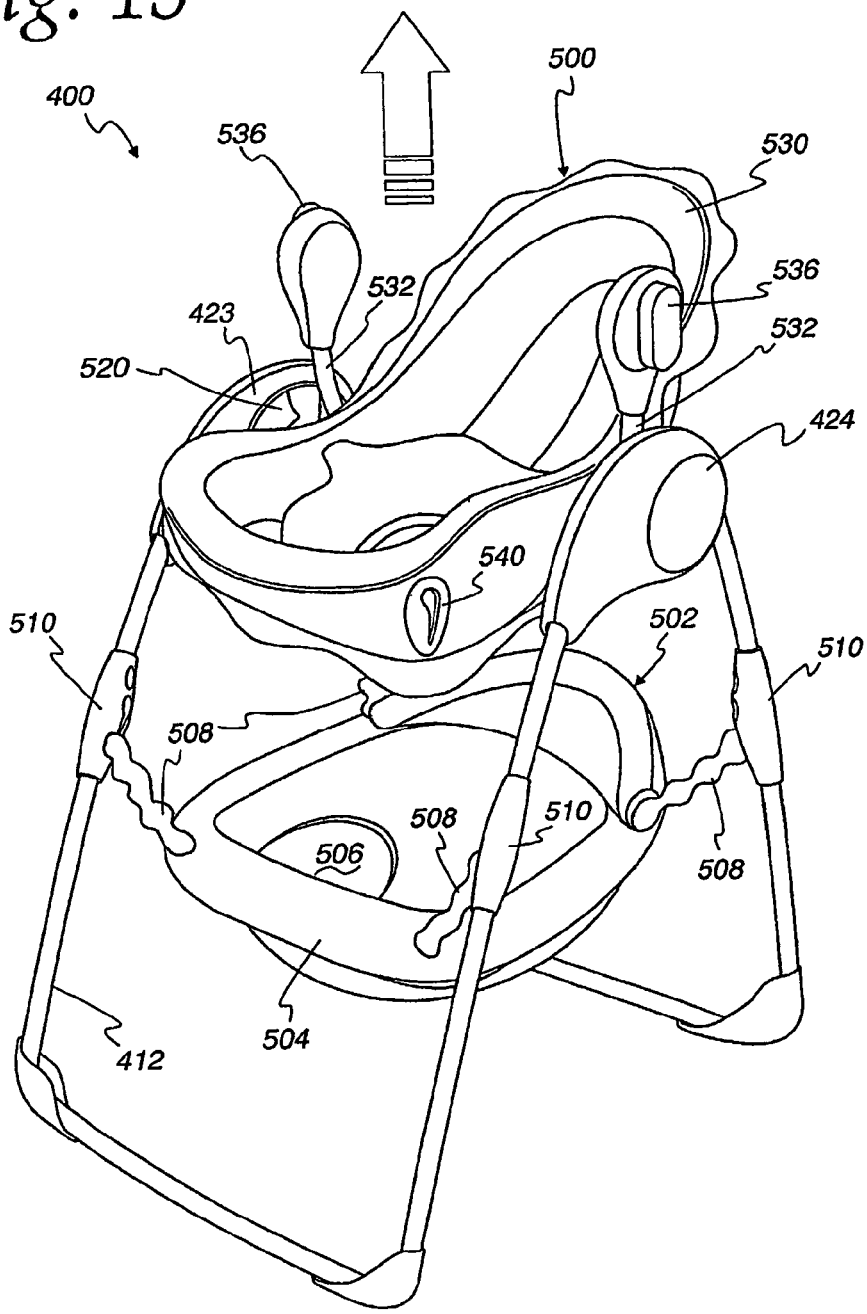
FIG. 15 is a view similar to FIG. 14, but showing the example child swing and jumper apparatus being converted between the swing mode and the jumper mode.
Figure 16:
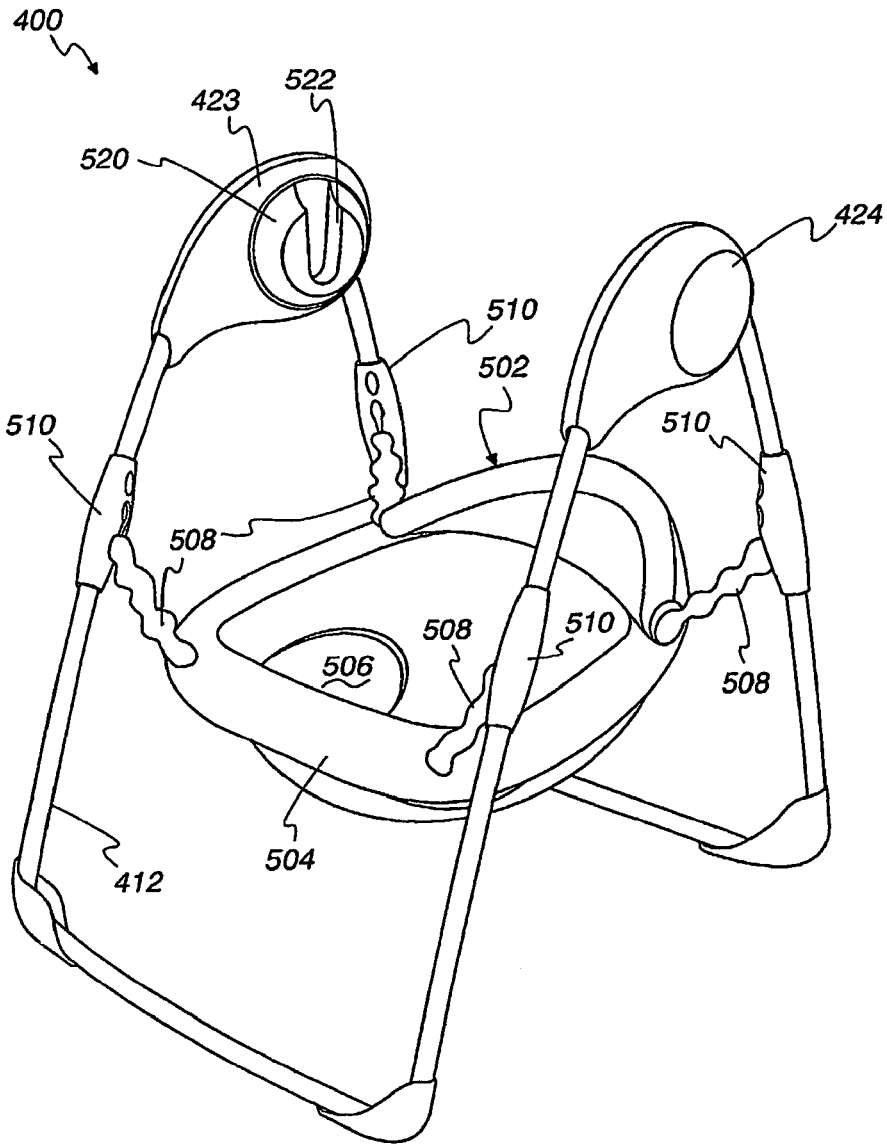
FIG. 16 is a view similar to FIG. 14, but showing the example child swing and jumper apparatus in the jumper mode.
Figure 17A:
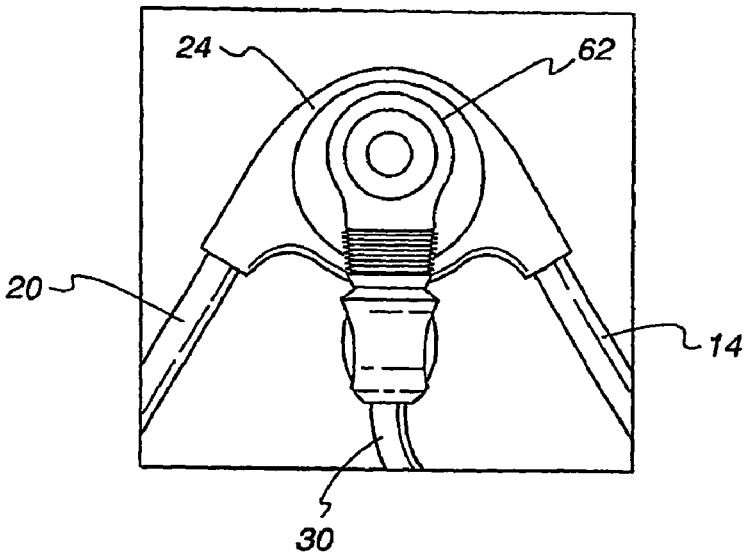
FIGS. 17A-17D illustrate an alternative example of a bypass connector that may be utilized in the apparatus of FIG. 1.
Figure 17B:
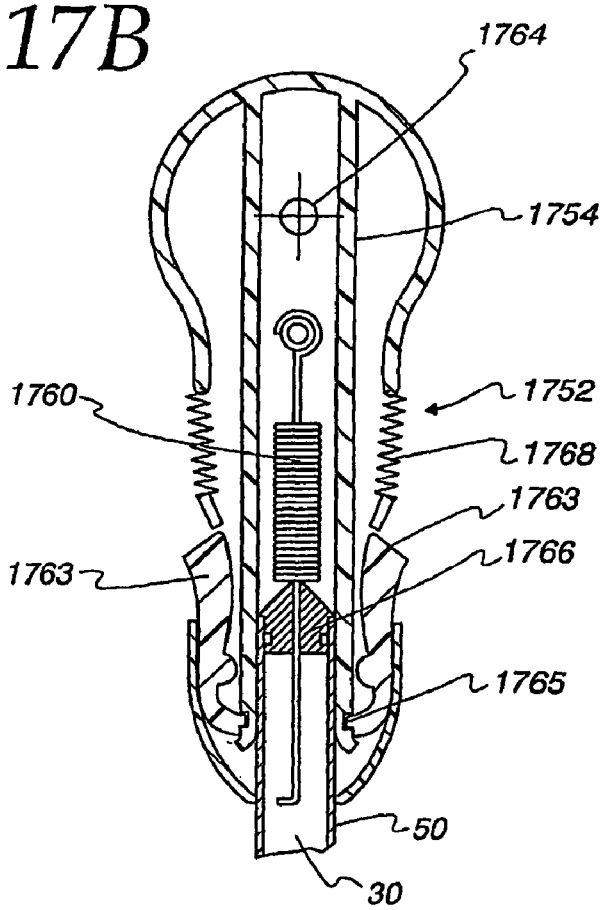
Figure 17C:
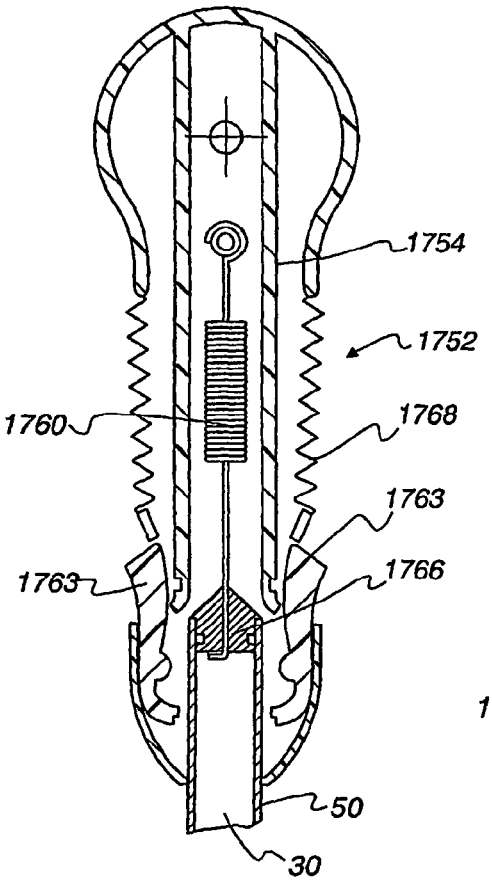
Figure 17D:
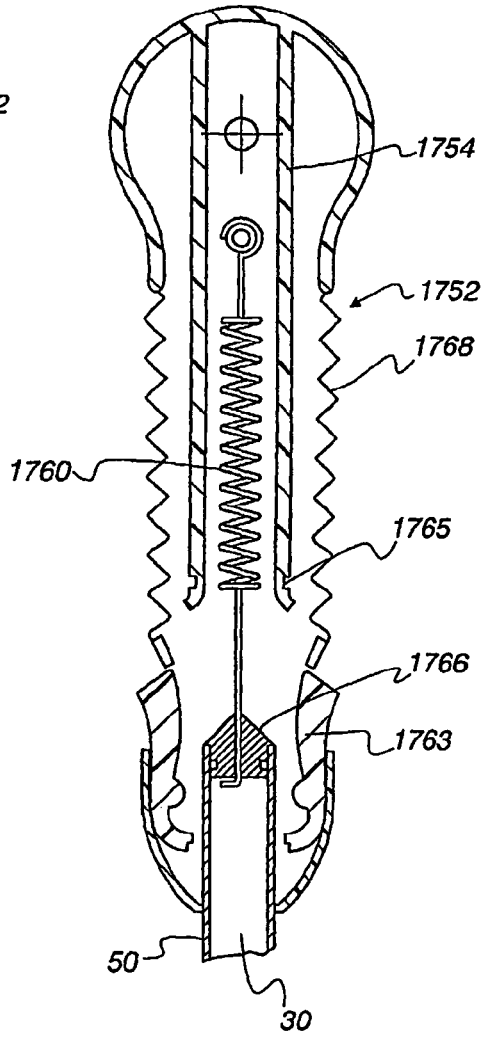
Figure 18A:
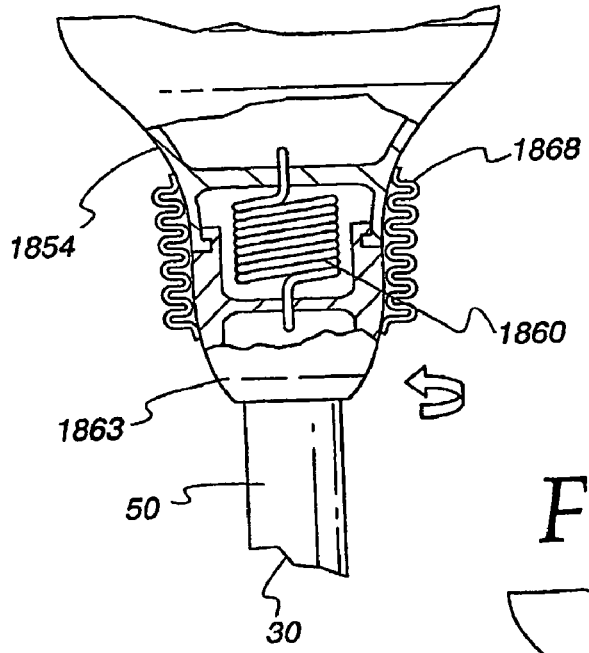
FIGS. 18A-18D illustrate an alternative example of a bypass connector that may be utilized in the apparatus of FIG. 1.
Figure 18B:
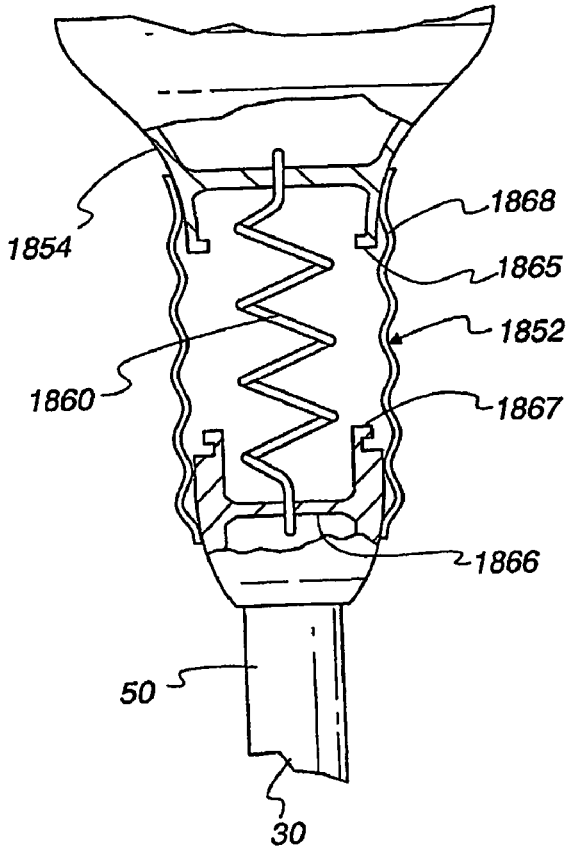
Figure 18C:
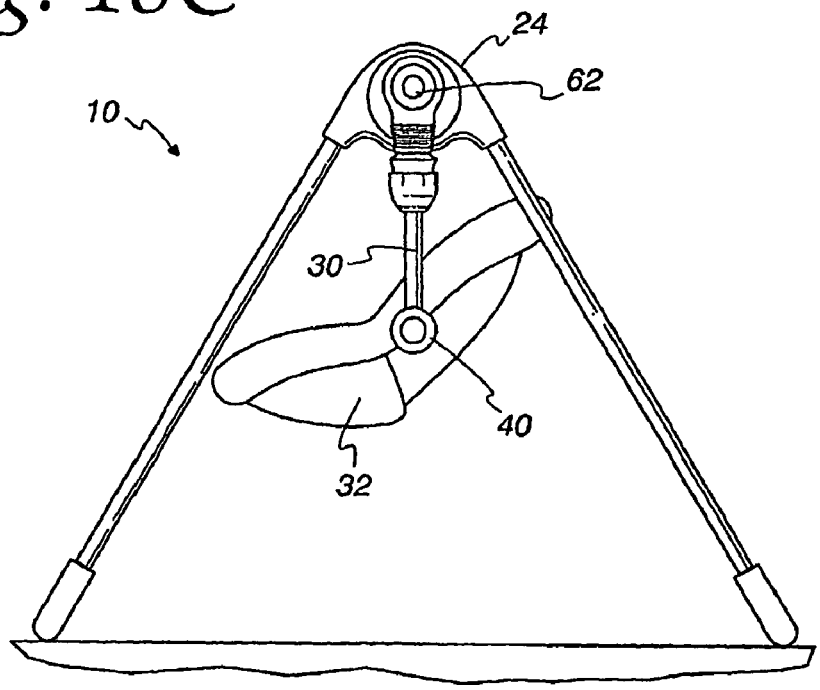
Figure 18D:
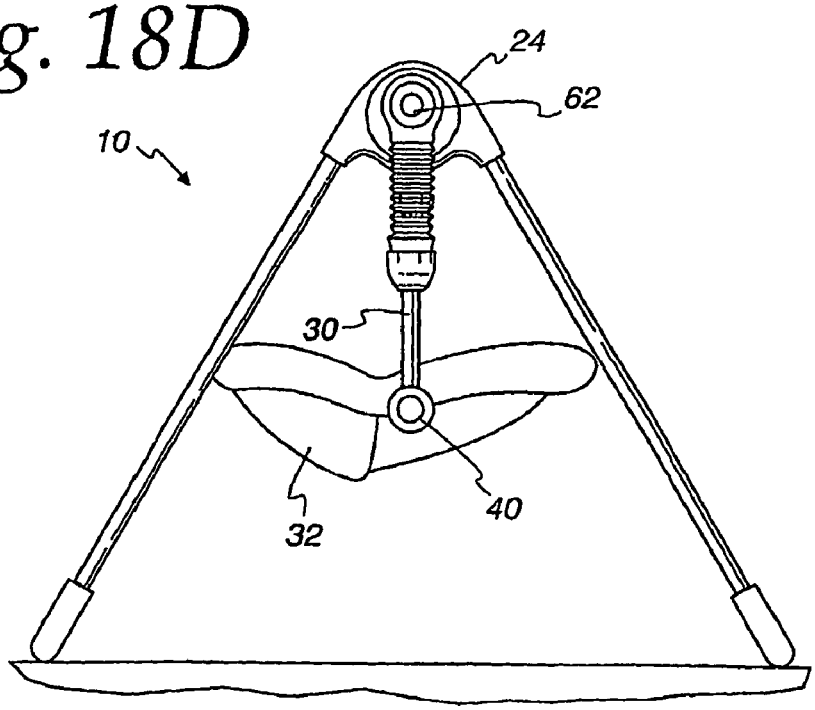

In the example of FIGS. 14-16, the seat assembly includes a swing seat assembly 500 and a jumper seat assembly 502. The swing seat assembly 500 and the jumper seat assembly 502 in the illustrated example are connected (although they need not be) when the apparatus 400 is in the swing mode (see FIG. 14). However, the swing seat assembly 500 and the jumper seat assembly 502 are not connected when the apparatus 400 is in the jumper mode (see FIG. 16).

Referring to FIG. 16, the jumper seat assembly 502 includes a seat 504 defining a pair of leg openings 506 in its bottom. To impart bouncing movement to the seat 504, one end of a flexible connector 508 is joined to each of four corners of the seat 504. The opposite ends of the flexible connectors 508 are free and are adapted to be received in a respective stationary connector 510. Each of the stationary connectors 510 is mounted on a respective one of the legs 414, 416, 418, 420. Thus, when the flexible connectors 508 are coupled to their respective stationary connectors 510, the seat 504 is suspended for bouncing movement between the legs 414, 416, 418, 420 of the frame 412.

To provide for children of different heights, the stationary connectors 510 in the illustrated example are constructed to secure the free ends of the flexible connectors 508 at a plurality of different heights. As a result, the height of the seat 504 relative to the floor is adjustable in the illustrated example. The flexible connectors 508 of the illustrated example are implemented by springs covered in plastic sleeves or the like to avoid pinch points; however, it will be appreciated that the flexible connectors 508 may be implemented with any suitable flexible material.

Referring to FIGS. 14 and 15, the swing seat assembly 500 includes a seat 530 and a pair of arms 532. The seat 530 may include a cover and/or cushion to provide comfort for the child. The arms 532 are preferably rigid tubular structures. Each of the arms 532 terminates in a lug 536.

As most easily seen in FIG. 16, a pair of rotatable hubs 520 rotatably mounted to the housings 423, 424 define channels 522 for receiving corresponding ones of the lugs 536. Thus, the swing seat assembly 500 may be suspended from the frame 412 by sliding the lugs 536 into their respective channels 522.

As shown in FIG. 15, the swing seat assembly 500 may be seated in and coupled to the jumper seat assembly 502. In particular, the swing seat assembly 500 includes stationary connectors 540 in which the free ends of the flexible connectors 508 may be secured to coupled the jumper seat assembly 502 to the swing seat assembly 500. Joining the swing seat assembly 500 and the jumper seat assembly 502 in this manner is advantageous for storing the jumper seat assembly 502. However, the swing seat assembly 500 may be used without being attached to the jumper seat assembly 502 is desired.

The various components of the apparatus 10, 400 can be made using any suitable plastic or metal materials utilized with swings and/or jumpers presently available.

FIGS. 17A-17D illustrate an alternative example of a convertible arm 30. In the illustrated example, a flexible section 1752 of the arm 30 includes at least one spring 1760 operatively coupled at one end to the hub 62, which is pivotally mounted to the housing 24 via an axle 1764. Specifically, the hub 62 is journalled on the axle 1764 for rotating motion. The other end of the spring 1760 is operatively coupled to the rigid section 50 of the arm 30 through a spring coupling 1766. The spring 1760 of the illustrated example is at least partially covered by a protective cover 1768 to reduce pinch points sometimes associated with the use of a spring. In the illustrated example, the rigid section 50 of the arm 30 includes a pair of integrated pivotable actuators 1763 to engage or disengage a bypass connector 1754.

In the illustrated example, the substantially rigid bypass connector 1754 at least partially surrounds the spring 1760. When the bypass connector 1754 is in the engaged position (FIG. 17B), it provides a rigid connection between the hub 62 and the rigid section 50 of the arm 30 via the engagement of the actuators 1763 into slots 1765 formed on the perimeter of a lower portion of the bypass connector 1754. In the illustrated example, the actuators 1763 are releasably attached to the bypass connector 1754 to secure the bypass connector 1754 in the engaged position. When in the disengaged position (FIGS. 17C, 17D), the actuators 1763 are pivoted so as to release the slots 1765 and the bypass connector 1754 is detached from the rigid section 50, thereby freeing the flexible section 1752 for expansion and compression to thereby provide a flexible connection between the hub 62 and the rigid section 50 of the arm 30. Conversely, when in the engaged position, the bypass connector 1754 provides a rigid link between the rigid section 50 and the hub 62, thereby precluding expansion and/or compression of the flexible section 1752.

FIGS. 18A-18D illustrate another alternative example of a convertible arm 30. In the illustrated example, a flexible section 1852 of the arm 30 includes at least one spring 1860 operatively coupled at one end to the hub 62, which is pivotally mounted to the housing 24 via an axle (not shown). The other end of the spring 1860 is operatively coupled to the rigid section 50 of the arm 30 through a spring coupling 1866. The spring 1860 of the illustrated example is at least partially covered by a protective cover 1868. In the illustrated example, the rigid section 50 of the arm 30 includes an integrated rotatable actuator 1863 to engage or disengage a bypass connector 1854.

In the illustrated example, the substantially rigid bypass connector 1854 at least partially surrounds the spring 1860. When the bypass connector 1854 is in the engaged position (FIGS. 18A, 18C), it provides a rigid connection between the hub 62 and the rigid section 50 of the arm 30 via the engagement of a lip 1867 formed on the upper portion of the actuator 1863 with a lip 1865 formed on the lower portion of the bypass connector 1854. In the illustrated example, the actuator 1864 is releasably attached to the bypass connector 1854 to secure the bypass connector 1854 in the engaged position. When in the disengaged position (FIGS. 18B, 18D), the actuators are rotated to release the lip 1865 of the bypass connector 1854 from the rigid section 50, thereby freeing the flexible section 1852 for expansion and compression to thereby provide a flexible connection between the hub 62 and the rigid section 50 of the arm 30. Conversely, when in the engaged position, the bypass connector 1854 provides a rigid link between the rigid section 50 and the hub 62, thereby precluding expansion and/or compression of the flexible section 1852.

Figure 19A:
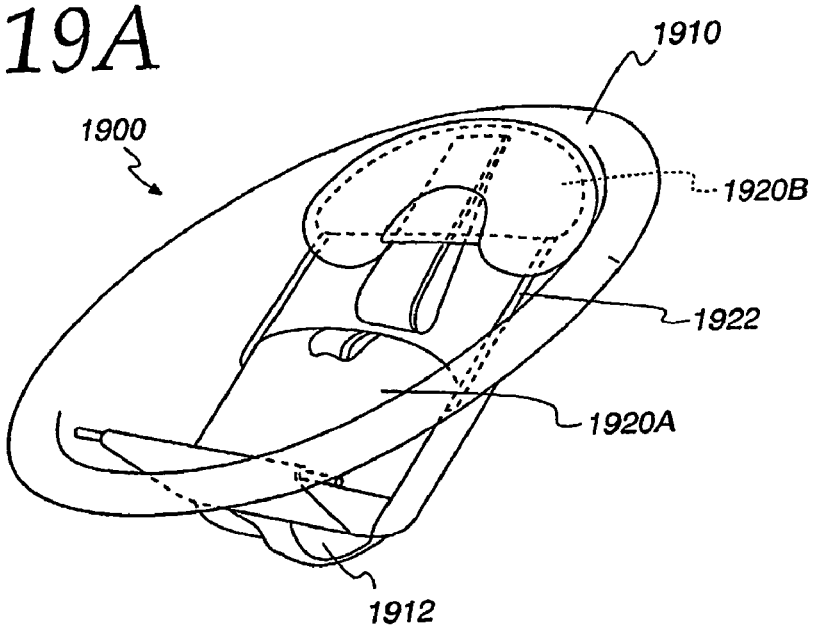
FIGS. 19A-19D illustrate an alternative example of a convertible swing/jumper seat that may be utilized in conjunction with the apparatus of FIG. 1.
Figure 19B:
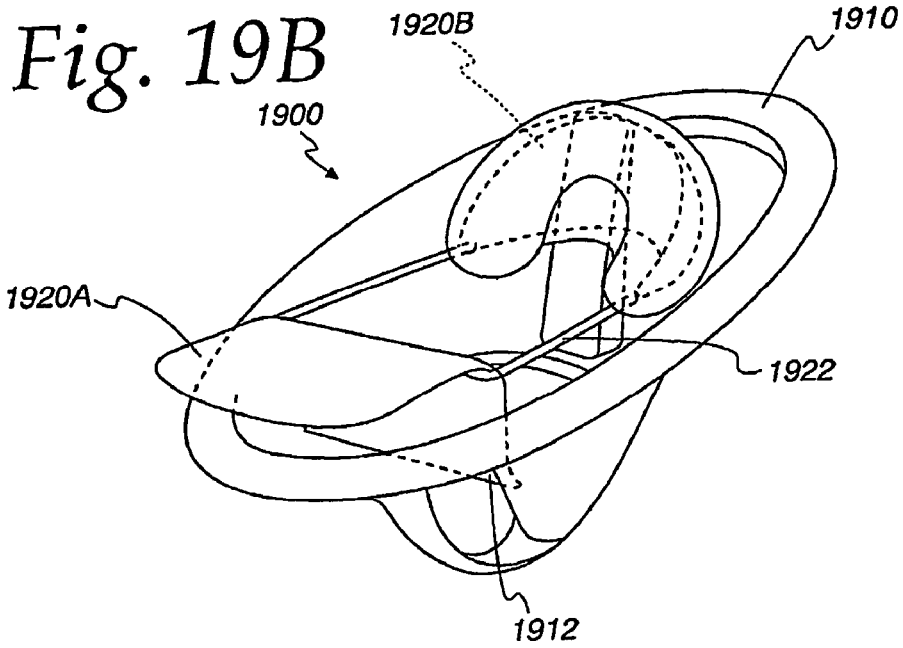
Figure 19C:
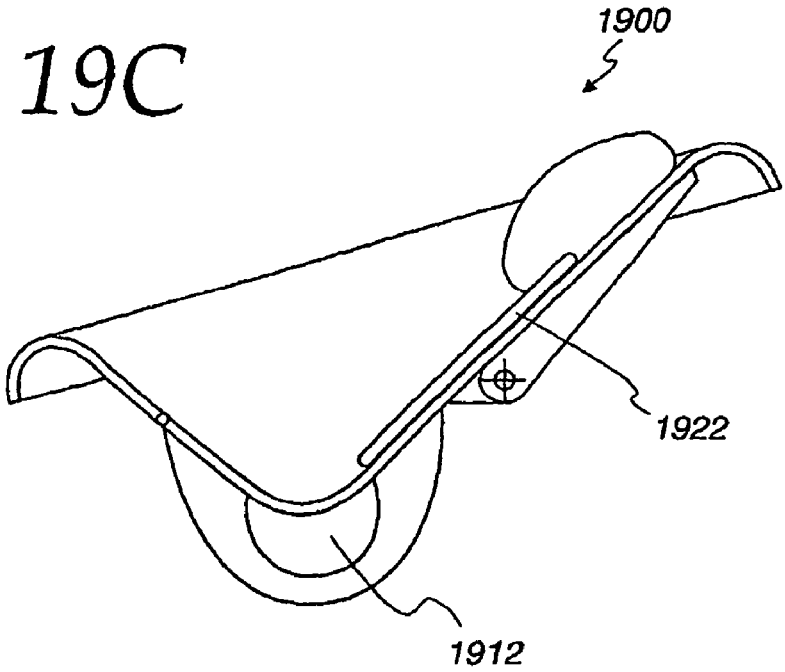
Figure 19D:
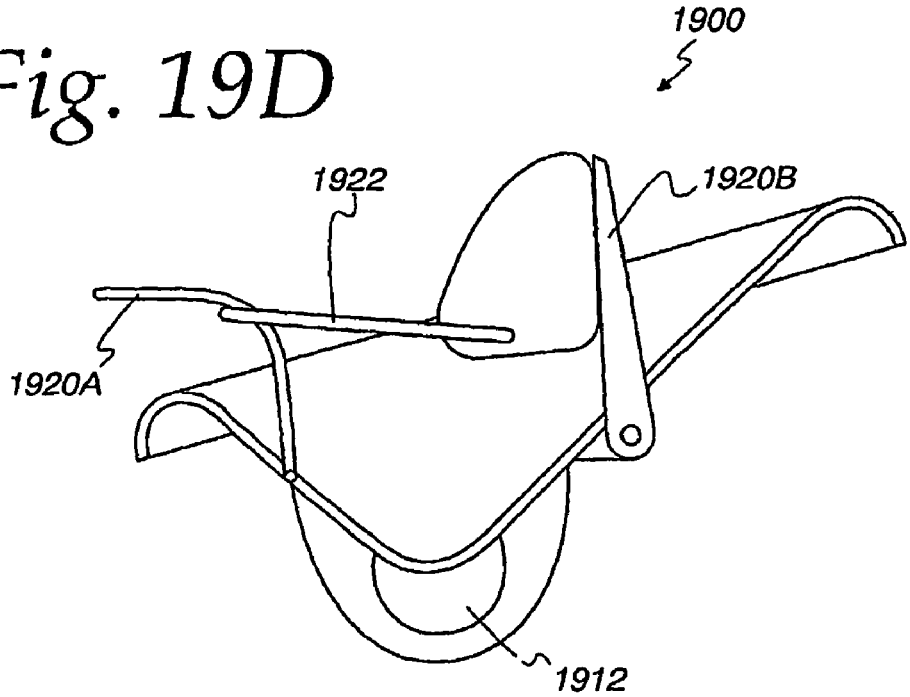

FIGS. 19A-19D illustrate another alternative example of a convertible swing/jumper seat 1900 that may be used in conjunction with the apparatus 10. In this example, the seat 1900 includes a shell 1910 such as, for example, a rigid plastic shell, defining leg openings 1912. The seat 1900 include a first pivotable seat bottom panel 1920A and a second pivotable seat bottom panel 1920B. In the illustrated example, the two panels 1920A and 1920B are operatively coupled together via a link 1922, such that movement of one of the panels will impart movement to the other panel. In this example, the pivotable seat bottom panel 1920A is pivotably coupled to the front of the shell of the seat 1900, and the second pivotable seat bottom panel 1920B is pivotably coupled to a mid-portion of the shell of the seat 1900. Moving the panels 1920A, 1920B between their lowered position and their raised position converts the seat 1900 between a feet forward position for use when the apparatus 10 is configured as a swing and a feet down position for use when the apparatus 10 is configured as a jumper. The leg openings 1912 are covered or substantially covered by the seat bottom panel 1920A when the seat bottom panels are in the position of FIG. 19A. As a result, an occupant of the seat 1900 must be positioned with their feet in a forward position. When, however, the seat bottom panels 1920A, 1920B are pivoted to their raised positions as shown in FIGS. 19B and 19D, the leg openings 1912 are exposed, and a child's legs may be inserted through an opening defined in the shell of the seat 1900 such that a child is suspended in the seat 1900 with his/her feet touching the ground for jumping and/or bouncing.

Figure 20A:
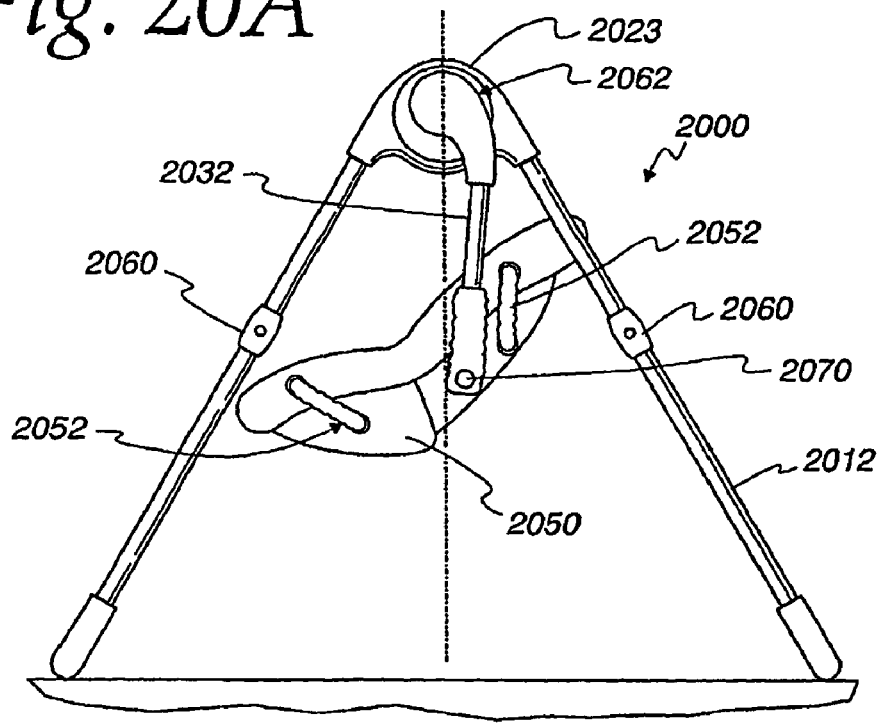
FIGS. 20A-20B are side elevational views of an alternative example child swing and jumper apparatus constructed in accordance with the teachings of the invention and showing the apparatus in both a swing mode and a jumper mode.
Figure 20B:
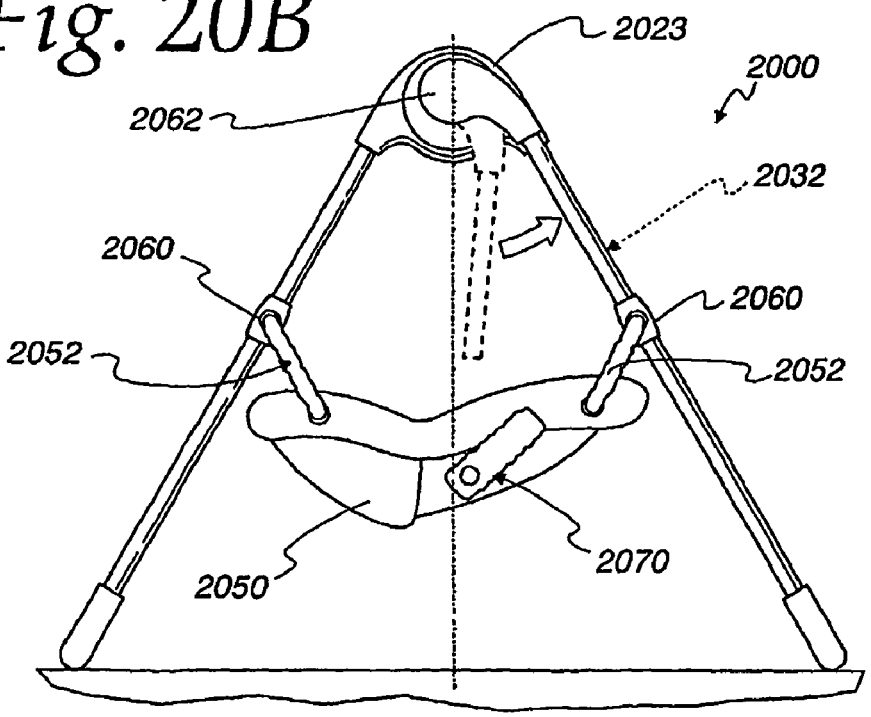

FIGS. 20A and 20B are side elevational views of an alternative example child swing and jumper apparatus 2000 constructed in accordance with the teachings of the invention. Like the apparatus 10, the apparatus 2000 of the illustrated example has two modes of operation. In a first mode (see FIG. 20A), the apparatus 2000 is operable as an infant swing. In a second mode (see FIG. 20B), the apparatus 2000 is operable as a jumper.

In the illustrated example, the apparatus 2000 is provided with a free standing frame 2012. The frame 2012 is an open top frame (i.e., there is no top cross-bar). The frame converges and is coupled to a first housing 2023 and a second housing (not shown). In the example apparatus 2000 one of the housings may also serve to house a swing motor which, when actuated, drives a seat assembly through a swing motion.

In the example of FIGS. 20A-20B, the seat assembly includes a swing seat 2050 defining a pair of leg openings (not shown) in its bottom. To impart bouncing movement to the seat 2050, one end of a flexible connector 2052 is joined to each of four corners of the seat 2050. The opposite ends of the flexible connectors 2052 are free and are adapted to be received in a respective stationary connector 2060. Each of the stationary connectors 2060 is mounted on a respective one of the legs of the frame 2012. Thus, when the flexible connectors 2052 are coupled to their respective stationary connectors 2060, the seat 2050 is suspended for bouncing movement between the legs of the frame 2012.

Referring to FIG. 20A, the swing seat 2050 includes a pair of arms 2032. The seat 2050 may include a cover and/or cushion to provide comfort for the child. The arms 2032 are preferably rigid tubular structures. Each of the arms 2032 terminates in a hub 2062, pivotally coupled to the housing 2023.

As most easily seen in FIG. 20B, the arms 2052 are releasable coupled to the seat 2050 at seat a seat connection 2070. When connected, (see FIG. 20A), the seat 2052 may be moved through a swinging motion under the hubs 2062 as previously disclosed.

Figure 21A:
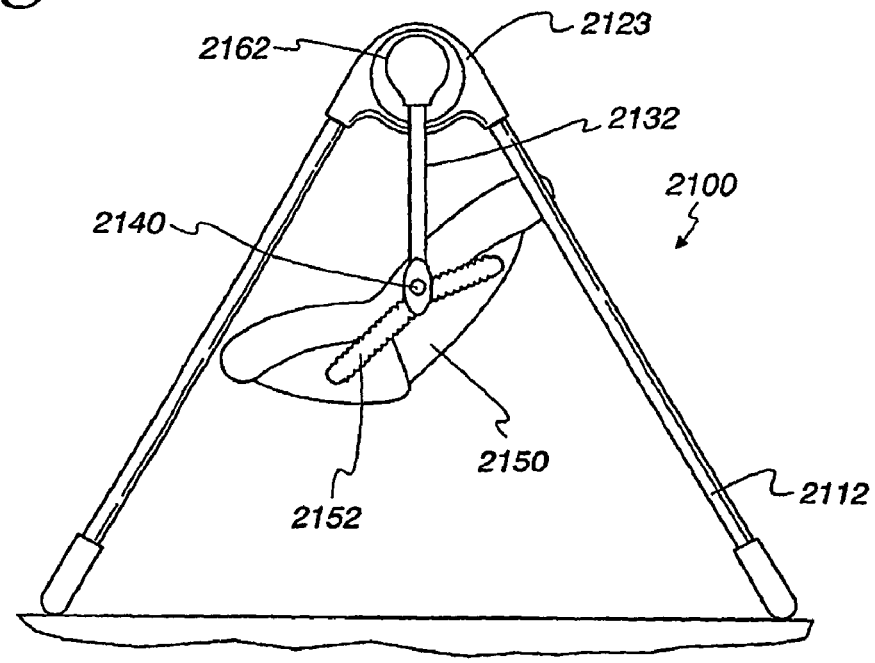
FIGS. 21A-21B are side elevational views of another alternative example child swing and jumper apparatus constructed in accordance with the teachings of the invention and showing the apparatus in both a swing mode and a jumper mode.
Figure 21B:
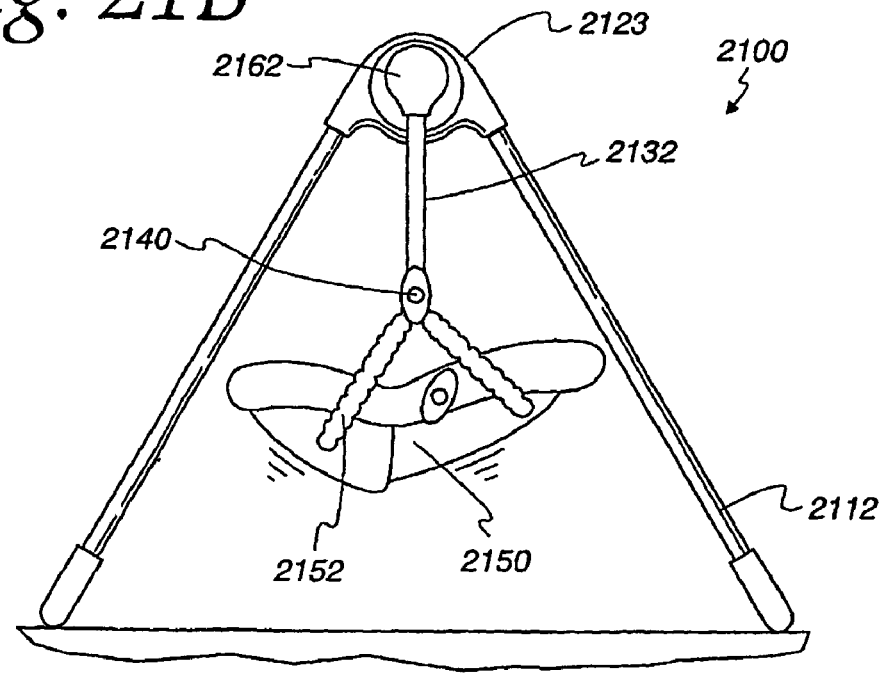

FIGS. 21A and 21B are side elevational views of another alternative example child swing and jumper apparatus 2100 constructed in accordance with the teachings of the invention. Like the apparatus 10, the apparatus 2100 of the illustrated example has two modes of operation. In a first mode (see FIG. 21A), the apparatus 2100 is operable as an infant swing. In a second mode (see FIG. 21B), the apparatus 2100 is operable as a jumper.

In the illustrated example, the apparatus 2100 is provided with a free standing frame 2112. The frame 2112 converges and is coupled to a first housing 2123, and a second housing 2124 (not shown). In the example apparatus 2100 the housing 2123 may also serve to house a swing motor which, when actuated, drives a seat assembly through a swing motion.

In the example of FIGS. 21A-21B, the seat assembly includes a swing seat 2150 defining a pair of leg openings (not shown) in its bottom. The swing seat 2150 includes a pair of arms 2132 pivotally coupled to the housings 2123. The arms 2132 are preferably rigid tubular structures. One end of each of the arms 2132 terminates in a hub 2162, pivotally coupled to the housing 2123. The other end of each of the arms 2132 is releasably coupled to the seat 2150 at a seat connector 2140 and is additionally operatively coupled to a flexible connector 2152 extending along each side of the seat 2150 and mounted between two of the four corners of the seat 2150. When connected, (see FIG. 21A), the seat 2152 may be moved through a swinging motion under the hubs 2162 as previously disclosed.

To impart bouncing movement to the seat 2150, the seat connector 2140 is released from engagement with the seat 2150 and the seat 2150 is suspended for bouncing movement between the legs of the frame 2112.

Although certain example methods, apparatus, and articles of manufacture have been described herein, the scope of coverage of this patent is not limited thereto. On the contrary, this patent covers all methods, apparatus, and articles of manufacture fairly falling within the scope of the appended claims either literally or under the doctrine of equivalents.

We claim:

1. A convertible child entertainment apparatus comprising: a frame; and a seat, the seat being coupled to the frame by a substantially rigid support when the apparatus is in a swing mode, and the seat being coupled to the frame through a substantially flexible support when the apparatus is in a jumper mode; wherein the substantially rigid support includes a substantially rigid section, a substantially flexible section, and an at least partially releasable bypass connector, such that when the bypass connector is not removed, the substantially rigid section of the substantially rigid support is coupled to the frame through the bypass connector, and such that when the bypass connector is at least partially removed, the substantially rigid section of the substantially rigid support is coupled to the frame through the substantially flexible section.

2. An apparatus as defined in claim 1, wherein the substantially flexible member is integral to the substantially rigid support.

3. An apparatus as defined in claim 1, wherein the substantially rigid support is convertible to the substantially flexible arm.

4. An apparatus as defined in claim 1, wherein the seat further comprises a shell and a seat bottom, the seat bottom being movable between a feet forward position and a feet down position.

5. An apparatus as defined in claim 4, wherein the seat defines leg openings, and wherein the leg openings are substantially covered by the seat bottom when in the feet forward position, and substantially uncovered by the seat bottom when in the feet down position.

6. An apparatus as defined in claim 5, wherein the seat is at least partially covered by a fabric covering, and wherein the fabric covering defines at least a portion of the leg openings.

7. An apparatus as defined in claim 5, wherein the seat bottom comprises a first seat bottom and a second seat bottom, wherein the second seat bottom is movable to overlap the first seat bottom when the first seat bottom is in the feet forward position and the second seat bottom is in a feet forward position, and to substantially uncover the leg openings when the first seat bottom is in the feet down position and the second seat bottom is in a feet down position.

8. An apparatus as defined in claim 1, wherein the at least a portion of the seat is adjustable between an upright position and a reclining position.

9. An apparatus as defined in claim 1, further comprising a swing motor coupled to the substantially rigid arm to swing the seat when the apparatus is in a swing mode.

10. An apparatus as defined in claim 9 further comprising a switch in circuit with the swing motor and positioned to interact with the apparatus to disable the swing motor when the apparatus is in the jumper mode.

11. An apparatus as defined in claim 1 wherein the seat comprises a frame and a cover secured to the frame, the cover including a seat bottom defining leg openings, a seat back and a flap, the flap being releasably securable to the seat to cover the leg openings and being releasably securable to the seat back to expose the leg openings.

12. A convertible child entertainment apparatus comprising: a frame; a seat; and means for suspending the seat from the frame, the suspending means having a first mode wherein the seat is suspended for operation as a swing and a second mode wherein the seat is suspended for operation as a jumper; wherein the suspending means includes a substantially rigid section, a substantially flexible section, and an at least partially releasable bypass connector, such that when the bypass connector is not removed, the substantially rigid section of the suspending means is coupled to the frame through the bypass connector, and such that when the bypass connector is at least partially removed, the substantially rigid section of the suspending means is coupled to the frame through the substantially flexible section.

13. An apparatus as defined in claim 12, further comprising a motor to impart swinging motion to the seat.

14. An apparatus as defined in claim 12, further comprising a switch in circuit with the motor and positioned to interact with the suspending means to disable the swing motor when the suspending means is in the second mode.

15. An apparatus as defined in claim 12, wherein the seat is convertible between a feet forward position and a feet down position.

16. An apparatus as defined in claim 12, wherein the seat further comprises: a shell; and a seat bottom pivotably coupled to the shell to convert the seat between the feet forward position and the feet down position.

17. An apparatus comprising: a frame; a substantially rigid support; and a convertible seat having a first mode wherein leg holes in a bottom of the seat are exposed to receive legs of a child and a second mode wherein the leg holes are covered; wherein the substantially rigid support includes a substantially rigid section, a substantially flexible section, and an at least partially releasable bypass connector, such that when the bypass connector is not removed, the substantially rigid section of the substantially rigid support is coupled to the frame through the bypass connector, and such that when the bypass connector is at least partially removed, the substantially rigid section of the substantially rigid support is coupled to the frame through the substantially flexible section.

18. An apparatus comprising: a flame; a swing seat assembly comprising: a swing seat; and at least one substantially rigid support arm having a free end to selectively suspend the swing seat assembly from the frame for swinging movement; and a jumper seat assembly comprising: a jumper seat; and a plurality of substantially flexible supports to suspend the jumper seat from the frame; wherein the substantially rigid support includes a substantially rigid section, a substantially flexible section, and an at least partially releasable bypass connector, such that when the bypass connector is not removed, the substantially rigid section of the substantially rigid support is coupled to the frame through the bypass connector, and such that when the bypass connector is at least partially removed, the substantially rigid section of the substantially rigid support is coupled to the frame through the substantially flexible section.

19. An apparatus as defined in claim 18, wherein the frame includes a housing and a pivotable hub supported by the housing, the hub defining a receptacle to receive the free end of the at least one support arm.

20. An apparatus as defined in claim 18, wherein the frame includes a plurality of receptacles to releasably secure the plurality of flexible supports to the frame.

21. An apparatus as defined in claim 18, wherein the plurality of receptacles include a first set of receptacles at a first height on the frame and a second set of receptacles on a second height of the frame to enable releasable securement of the jumper seat to the frame at the first or second heights.

22. An apparatus as defined in claim 18, wherein the swing seat assembly includes a plurality of receptacles to releasably secure the plurality of flexible supports to the swing seat assembly.

23. An apparatus as defined in claim 1, wherein the substantially rigid support is positioned to selectively deactivate the substantially flexible support when the apparatus is in the swing mode.

24. An apparatus as defined in claim 23, wherein the substantially rigid support is movable between a released position and a secured position to convert the apparatus between the swing and jumper modes.

25. An apparatus as defined in claim 23, wherein the substantially rigid support is pivotable relative to the substantially flexible support.

26. An apparatus as defined in claim 23, wherein the jumper mode permits the seat to bounce relative to the frame, and wherein the swing mode suspends the seat at a fixed height.

* * * * *